US008025174B2

(12) United States Patent
Martheenal

(10) Patent No.: US 8,025,174 B2
(45) Date of Patent: Sep. 27, 2011

(54) RESIDENTIAL RECYCLING BIN

(75) Inventor: Basil T. Martheenal, Brampton (CA)

(73) Assignee: Orbis Canada Limited, Toronta, Ontario (CA)

( * ) Notice: Subject to any disclaimer, the term of this patent is extended or adjusted under 35 U.S.C. 154(b) by 545 days.

(21) Appl. No.: 12/130,324

(22) Filed: May 30, 2008

(65) Prior Publication Data

US 2009/0294451 A1 Dec. 3, 2009

(51) Int. Cl.
*B65D 25/14* (2006.01)
*B65D 21/02* (2006.01)

(52) U.S. Cl. ..... 220/495.11; 206/510

(58) Field of Classification Search ..... 220/495.11, 220/495.08, 4.26, 763, 762, 761, 495.06, 220/23.86, 908.1, 908, 23.83, 4.27, 752, 220/675, 669, 623, 610, 756, 760, 759; 206/512, 206/511, 510, 509, 567, 557, 505; D34/6, D34/5, 1; *B65D 21/036, 21/032, 21/06, 21/00*
See application file for complete search history.

(56) References Cited

U.S. PATENT DOCUMENTS 3,113,680 A 12/1963 Frater et al.
3,347,394 A 10/1967 Gould
3,534,866 A 10/1970 Asenbauer
3,756,451 A * 9/1973 Popeil ..... 220/736
3,825,150 A 7/1974 Taylor
4,003,611 A * 1/1977 Smith ..... 312/244
4,027,774 A * 6/1977 Cote ..... 220/495.11
4,161,252 A 7/1979 Howells
4,205,749 A 6/1980 Carroll et al.
4,753,367 A 6/1988 Miller et al.
4,867,339 A * 9/1989 Hahn ..... 220/495.1
4,867,340 A * 9/1989 Byers ..... 220/495.11
4,946,065 A * 8/1990 Goulter et al. ..... 220/495.1
5,071,008 A 12/1991 Hradisky
5,160,063 A 11/1992 Bailey
5,445,397 A 8/1995 Evans
5,645,186 A * 7/1997 Powers et al. ..... 220/495.11
5,881,901 A 3/1999 Hampton
D515,313 S 2/2006 Uffner et al.
2007/0062960 A1* 3/2007 Splain et al. ..... 220/669
2008/0006638 A1* 1/2008 Yang et al. ..... 220/495.11
2008/0121547 A1* 5/2008 Dur et al. ..... 206/511

FOREIGN PATENT DOCUMENTS

EP 1760011 A2 3/2007

* cited by examiner

*Primary Examiner* — Robert J Hicks
(74) *Attorney, Agent, or Firm* — Ungaretti & Harris LLP

(57) ABSTRACT

A recycling bin has a left and right sidewall, a base, and front wall; the front wall is lower than the other three walls, and when two bins are stacked in a 0° stacking configuration, the lower front wall of the lower bin and a sloped surface on the lower portion of the upper bin create a recyclable receiving chute that accepts recyclable materials freely. When in the stacked configuration, the upper bin is substantially securely held to the lower bin by a combination of a channel on the lower rear portion of the base that fits over a handle that rests upon on upper portion of the rear wall. Furthermore, a lower lip on the lower portion of the rear wall aligns with the handle and substantially prevents front-wards and backwards motion of the upper bin.

29 Claims, 14 Drawing Sheets

RESIDENTIAL RECYCLING BIN

BACKGROUND OF THE INVENTION

1. Field of the Invention

The invention relates to plastic bins. More particularly, the invention relates to a home or residential recycling system and method for its use.

2. Background Art

With the increased concern and awareness for the environment throughout the world, recycling has become an accepted part of modern society. Many different common everyday items that can be recycled include: glass; metals; plastics; paper; and various other products. For example, in various localities within the United States, people are accustomed to recycling plastic, metals and glass certain days of the week with their garbage collection, and on other days, paper materials can be collected for recycling. These recycled products are then commonly bundled and sold to manufacturers or fabricators of various components that utilize these materials or sold in bulk for reuse in producing new items.

Accordingly, recycling bins are common in the prior art. U.S. Pat. No. D515,313 relates to a stackable front entry storage tote. U.S. Pat. No. 5,881,901 (hereinafter the '901 patent), relates to a receptacle designed to hold recycled plastic bags as inner-liners. The refuse receptacle of the '901 patent is designed to hold in place a recycled plastic bag as an inner-liner via a molded plastic container that is specially dimensioned to securely fit a recycled plastic bag, and especially designed with side handles that have recessed ends which, when the handles of recycled plastic bag are hooked underneath, are meant to securely hold the recycled plastic bag in place as an inner-liner for the receptacle. U.S. Pat. No. 5,445,397 (hereinafter the '397 patent), relates to a stackable refuse container system that includes multiple stacks of containers, each of which may be designated for holding a particular recyclable material. The containers can be vertically stacked and a cart can be provided for transporting the stack assembly to and from a curb. Each container may include removable lid, the front portion of the lid being usably attached to provide access to the container and a second portion formed to engage and support a bottom of a complimentary container. Each container also has sockets for receiving the feet of another container when a lid is not used. Thus, containers can be stacked one upon another, with the lids on or off, and mounted on the cart if one is used. The containers can be provided for separating recyclable from non-recyclable materials at the point of origin without taking up substantial space.

U.S. Pat. No. 5,071,008 (hereinafter the '008 patent), relates to a nestable and stackable container capable of being stacked on or nested with a like container. The container includes a bottom, with a front wall, a rear wall and two side walls extending upwardly from the bottom to an upper rim, thereby forming the container with an open top. The side walls taper away from each other as they extend upwardly from the bottom to the rim, and are each provided with outer depressions forming inner projections. The top of each of the inner projections is formed as a ledge that includes an upper step and a lower step. A rib extends upwardly from each lower step. Sockets are formed in the bottom and the socket of the like container is lineable with and receives the ribs of the container so that the containers may be stacked. The outer depressions are spaced from each other to form inner depressions and outer projections in each side wall. The rim has a first sloping surface extending from the front wall along each side wall and a second sloping surface extending from the rear wall to the first sloping surface. The container may then be nested within the like container by positioning the container on the bottom or the like container on the sloping surface, and sliding the outer projections of the like container into the inner depression of the container while at the same time sliding the outer depressions of the like container over the inner projections of the container.

U.S. Pat. No. 4,205,749 (hereinafter the '749 patent), relates to a nestable and stackable container for eggs packaged in cartons. The configuration of the container permits stacking when filled, nesting when empty, and is provided with main receiving and positioning packaging strapping material above the exterior of the container to facilitate assembly of multiple containers for prioritizing and shipping.

U.S. Pat. No. 4,161,252 (hereinafter the '252 patent), relates to a set of sorting, stacking bins that include a plurality of tapered containers, each having a upstanding, inclined walls, and an integral horizontal bottom, and wherein the container is shippable in nested conditions to reduce costs. Each container has a horizontally enlarged base with depending peripheral flanges that fit over the rim of the next lower container. Bases are shifted separately flat-wise against each other to reduce costs. Upon delivery, each container is snap-fitted on a large base to form an integral, permanent unit. Units are vertically stackable, one on the other, each having a large top opening for receiving a particular type of waste. U.S. Pat. No. 3,534,866 (hereinafter the '866 patent), relates to a stacking and nesting bin box of a generally rectangular configuration, including a flat bottom wall, an upstanding side and end walls, the front end wall being cut away at its upper center to provide a bin opening, and the side walls being convoluted inwardly at a point near to the rear end wall, which will provide a pair of stacking posts for stackably supporting a superimposed identical container.

U.S. Pat. No. 3,347,394 (hereinafter the '394 patent), relates to stacked storage bins, for small parts or articles. The bins are adapted to be stacked one upon the other, such that the bins results in a secure stacking and inter-locking of the bins. The stacking and/or interlocking of bins permits allegedly easier handling of the articles particularly in extracting them from a bin. U.S. Pat. No. 3,113,680 (hereinafter the '680 patent), relates to stacking and nesting containers which are adapted for stacking one upon the other when in use, and which can be nested one in the other when not in use. EP Patent No. 1760011 (hereinafter the '011 patent), relates to a container particularly for sorted waste collection, comprising a container body, which forms internally at least one collection receptacle provided with at least one access opening located in the upper part of the container body. The container has means for closing the access opening, which can move with respect to the container body in order to pass from a closed condition to an open condition of the access opening and vice-a-versa, the closure means comprising at least one first closure element and at least one second closure element, which is supported by the container body and designed to close respective portion of the access opening. The first closure element pivots with respect to the container body and the second closure element is pivots with respect to the first closure element.

U.S. Pat. No. 4,753,367 (hereinafter the '367 patent), relates to a waste basket and inner-liner retainer, which is adapted to receive an inner-liner that includes a container having an upper rim defining an open end, and a lid pivotally mounted on the container and adapted to cover the open end. A bezel is provided for retaining an inner-liner in the container. The bezel is pivotally mounted on the container at its open, and is pivotable between first position, when the bezel is disposed substantially co-planarly with the upper rim of the container, and the second position, where the bezel is raised at an angle above the rim of the container. The waste basket also includes structure from pivotally mounting the bezel to the container for retaining the bezel in the raised second position. U.S. Pat. No. 5,160,063 relates to a refuse receptacle, and U.S. Pat. No. 3,825,150 (hereinafter the '150 patent), relates to a waste receptacle having liner bag holders. The receptacle of the '150 patent illustrates a receptacle having integral resilient tabs formed on the side walls and adapted to be sprung inwardly by pressing on the exterior surface for engaging under and pinching the periphery of the liner bag between the tabs and the adjacent receptacle wall.

Thus, all of the cited prior art references have deficiencies that make known recycling bins substantially more difficult to use. Therefore, a need exists for an improved home or residential recycling bin to overcome the problems of the prior art.

SUMMARY OF THE INVENTION

It is therefore a general aspect of the invention to provide a residential recycling bin that will obviate or minimize problems of the type previously described.

According to a first aspect of the present invention, a bin is provided comprising: a base, a left sidewall, a right sidewall, a front wall; and a rear wall, all fixedly connected to each other, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base, and wherein each of the right sidewall and the left sidewall includes at least one respective inverted "V"-shaped liner retaining device configured to retain at least one liner.

Further according to the first aspect, the first, second, third and fourth predetermined angle measures between about 92.5° and about 94.5°, or the first, second, third and fourth predetermined angle measures between about 93.3° and about 93.7°, or, the first, second, third and fourth predetermined angle measures about 93.5°.

According to the first aspect, each of the left sidewall and right sidewall includes a respective front sloped portion, wherein a height of the front wall is substantially equal to a lowest height of each of the left and right sidewall front sloped portions. The left sidewall front sloped portion is formed at a fifth predetermined angle with respect to an upper surface of the left sidewall, and the right sidewall front sloped portion is formed at a sixth predetermined angle with respect to an upper surface of the right sidewall.

According to the first aspect, the fifth and sixth predetermined angle measures between about 45° and 55°, or, the fifth and sixth predetermined angle measures between about 47.5° and 52.5°, or, alternatively, the fifth and sixth predetermined angle measures about 50°.

According to the first aspect, the bin further comprises a handle, wherein the handle is configured to be freely rotatable, and further wherein the handle can be rotated to a resting position upon a top portion of the rear wall; a rear base groove, located at a rearward portion of the base; and a rear wall lower lip, located at a lowermost portion of the rear wall, wherein the rear base groove and the rear wall lower lip of a first upper bin are configured to jointly operate to fit about the handle of a substantially similar second lower bin, when the handle of the second lower bin is in the resting position, to substantially prevent the first upper bin from sliding or moving forward with respect to the second lower bin.

According to the first aspect, when the handle is placed in the resting position upon the top portion of the rear wall of the bin, the handle is configured to retain a liner in the bin, and when the handle is placed in the resting position upon the top portion of the rear wall of the bin, the handle is configured to provide a smooth, substantially planar surface formed by respective upper surfaces of the left sidewall and the right sidewall, and an upper surface of the handle.

According to a second aspect of the present invention, a bin is provided comprising: a base, a left sidewall, a right sidewall, a front wall; a rear wall, all fixedly connected to each other, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base, and wherein the rear wall includes a top open portion, such that a height of the rear wall is less than a height of the each of the left sidewall and right sidewall, and each of the left sidewall and the right sidewall includes an upper surface that is substantially co-planar with each other; and a handle, wherein the handle includes a liner retention portion, a first and second arm portion, and a first and second rotatable mounting portion, wherein the handle is configured to be placed in any one of a liner retention position, a resting position, and a bin carrying position, and rotatable through the positions, and wherein the liner retention portion is sized to fit within the top open portion of the rear wall when the handle is in the liner retention position, such that a substantially planar surface is formed by the upper surface of the left sidewall, the upper surface of the right sidewall, and an upper surface of the liner retention portion of the handle.

According to the second aspect, the first, second, third, and fourth predetermined angle measures between about 92.5° and about 94.5°, or the first, second, third, and fourth predetermined angle measures between about 93.3° and about 93.7°, or, alternatively, the first, second, third, and fourth predetermined angle measures about 93.5°.

According to the second aspect, each of the left sidewall and right sidewall includes a respective front sloped portion, wherein a height of the front wall is substantially equal to a lowest height of each of the left and right sidewall front sloped portions. According to the second aspect, the left sidewall front sloped portion is formed at a fifth predetermined angle with respect to an upper surface of the left sidewall, and the right sidewall front sloped portion is formed at a sixth predetermined angle with respect to an upper surface of the right sidewall.

According to the second aspect, the fifth and sixth predetermined angle measures between about 45° and 55°, or the fifth and sixth predetermined angle measures between about 47.5° and 52.5°, or alternatively, the fifth and sixth predetermined angle measures about 50°.

According to a third aspect of the present invention, a bin is provided comprising: a base, a left sidewall, a right sidewall, a front wall; a rear wall, all fixedly connected to each other, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base; a handle, wherein the handle is configured to be freely rotatable, and further wherein the handle can be rotated to a resting position upon a top portion of the rear wall; a rear base groove, located at a rearward portion of the base; and a rear wall lower lip, located at a lowermost portion of the rear wall, wherein the rear base groove and the rear wall lower lip of a first upper bin are configured to jointly operate to fit about the handle of a substantially similar second lower bin, when the handle of the second lower bin is in the resting position, to substantially prevent the first upper bin from sliding or moving forward with respect to the second lower bin.

According to the third aspect, the first, second, third, and fourth predetermined angle measures between about 92.5° and about 94.5°, or the first, second, third, and fourth predetermined angle measures between about 93.3° and about 93.7°, or, alternatively, the first, second, third, and fourth predetermined angle measures about 93.5°.

According to the third aspect, each of the left sidewall and right sidewall includes a respective front sloped portion, wherein a height of the front wall is substantially equal to a lowest height of each of the left and right sidewall front sloped portions. According to the third aspect, the left sidewall front sloped portion is formed at a fifth predetermined angle with respect to an upper surface of the left sidewall, and the right sidewall front sloped portion is formed at a sixth predetermined angle with respect to an upper surface of the right sidewall.

According to the third aspect, the fifth and sixth predetermined angle measures between about 45° and 55°, the fifth and sixth predetermined angle measures between about 47.5° and 52.5°, and the fifth and sixth predetermined angle measures about 50°.

According to a fourth aspect of the present invention, a method for using a residential recycling bin is provided, comprising the steps of: inserting a liner into the residential recycling bin; inserting a first upper portion of the liner into a first inverted "V"-shaped liner retainer, and a second upper portion of the liner into a second inverted "V"-shaped liner retainer, wherein the first and second inverted "V"-shaped liner retainers are configured to substantially prevent the liner from slipping into an interior portion of the residential recycling bin; and placing recyclable materials into the liner.

According to a fifth aspect of the present invention, a method is provided for using a residential recycling bin, wherein the bin includes a rotatable handle, the method comprising the steps of: inserting a liner into the residential recycling bin; positioning a portion of the liner over an upper portion of a rear wall of the residential recycling bin; placing the handle in a liner storage position, such that the handle forms a substantially even, planar surface with upper portions of left and right sidewalls of the residential recycling bin, whereby the liner is substantially prevented from slipping into an interior portion of the residential recycling bin; and placing recyclable materials into the liner.

According to the fifth aspect, the step of placing the handle in a liner storage position comprises retaining the liner substantially in the bin by the handle when the handle is in the liner storage position over the rear wall.

According to a sixth aspect of the present invention, a bin is provided comprising: a base, a left sidewall, a right sidewall, a front wall; and a rear wall, all fixedly connected to each other, wherein the front wall includes a respective upper surface, the rear wall includes a respective upper surface, the front wall extends from the base at a first predetermined angle to the base, the rear wall extends from the base at a second predetermined angle to the base, the left sidewall extends from the base at a third predetermined angle to the base, the right sidewall extends from the base at a fourth predetermined angle to the base, and each of the left sidewall and the right sidewall further includes a respective upper surface substantially coplanar with each other, and wherein each of the left sidewall and right sidewall includes a respective front sloped surface, and wherein a height of the upper surface of the front wall is lower that the respective heights of the upper surfaces of the left sidewall, rear wall, and right sidewall, the left sidewall front sloped surface and the right sidewall front sloped surface slope downwardly at a fifth predetermined angle from the upper surface of the left side wall upper surface and right sidewall upper surface, respectively, and wherein the left sidewall front sloped surface, the right sidewall sloped surface, and the front wall upper surface are configured to form a first opening in the bin, and wherein the base includes an upwardly sloping surface that slopes upwardly from the base at a sixth predetermined angle that intersects with the front wall, such that, when a first upper bin is stacked upon a substantially similar second lower bin, and the front walls of the first upper bin and the substantially similar second lower bin face a same direction, the upwardly sloping surface of the base of the first upper bin and the first opening in the substantially similar second lower bin are configured to form a recyclable receiving chute configured to accept recyclable materials deposited in the substantially similar second lower bin.

According to the sixth aspect, the recyclable receiving chute that is formed from the first upper bin when it is stacked upon the second lower bin forms an angular opening that measures between about 87.2° and about 99.2°.

According to the sixth aspect, the recyclable receiving chute that is formed from the first upper bin when it is stacked upon the second lower bin forms an angular opening that measures between about 90.2° and about 96.2°.

According to the sixth aspect, the recyclable receiving chute that is formed from the first upper bin when it is stacked upon the second lower bin forms an angular opening that measures about 93.2°.

According to the sixth aspect, the first, second, third, and fourth predetermined angle measures between about 92.5° and about 94.5°, or the first, second, third, and fourth predetermined angle measures between about 93.3° and about 93.7°, or, alternatively, the first, second, third, and fourth predetermined angle measures about 93.5°.

According to the sixth aspect, the fifth predetermined angle measures between about 45° and about 55°, or the fifth predetermined angle measures between about 47.5° and about 52.5°, or, alternatively, the fifth predetermined angle measures about 50°.

According to the sixth aspect, the sixth predetermined angle measures between about 135.8° and about 137.8°, or the sixth predetermined angle measures between about 136.6° and about 137°, or the sixth predetermined angle measures about 136.8°.

BRIEF DESCRIPTION OF THE DRAWINGS

The novel features and advantages of the present invention will best be understood by reference to the detailed description of the preferred embodiments that follows, when read in conjunction with the accompanying drawings, in which.

DETAILED DESCRIPTION OF THE PREFERRED EMBODIMENTS

Figure 1:
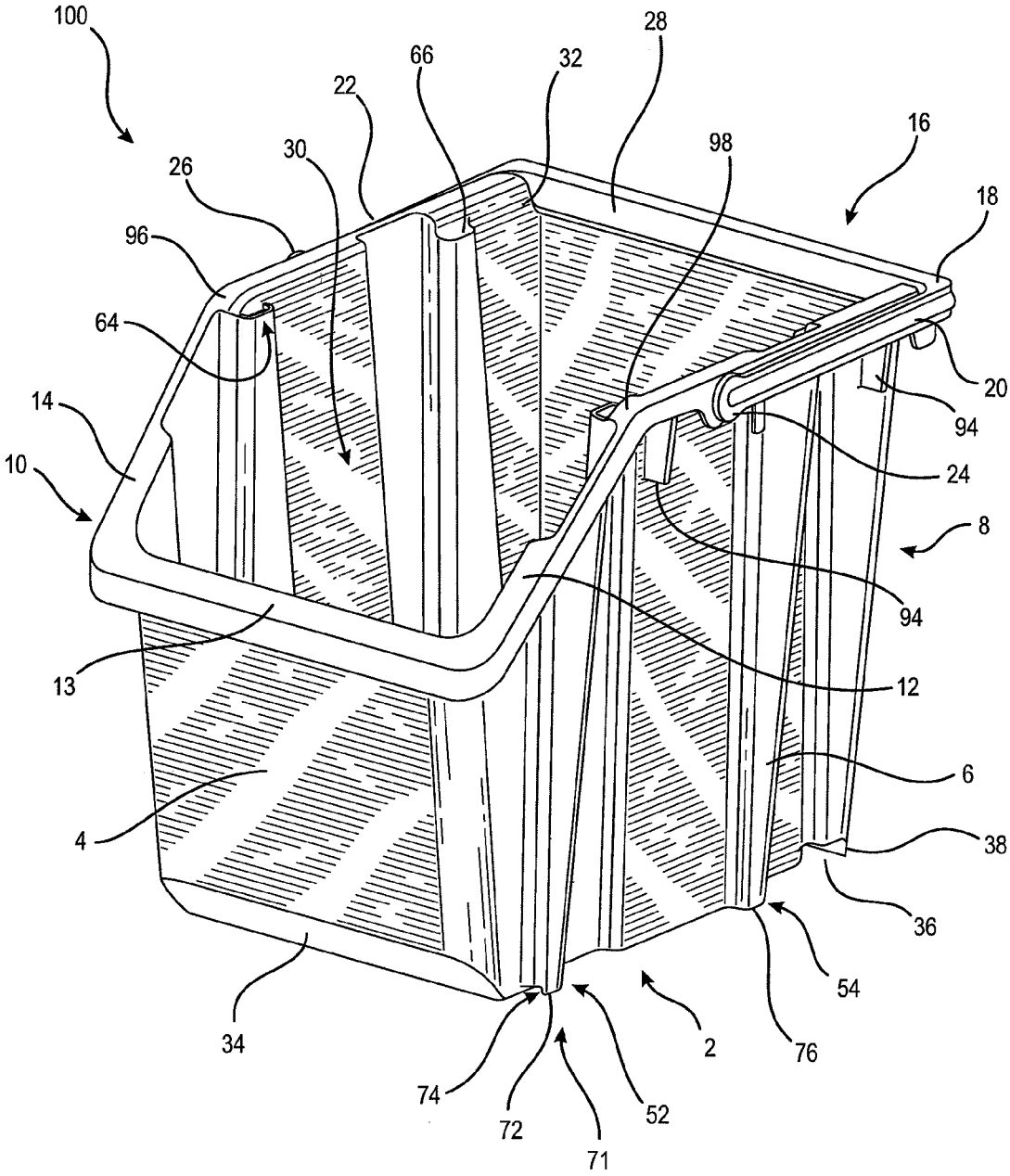
FIG. 1 illustrates a front perspective view of a residential recycling bin according to an embodiment of the present invention.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. Introduction

Residential recycling bin (bin) 100 according to exemplary embodiments comprises front wall 4, left side wall 6, rear wall 8, right side wall 10, and base 2. Front wall 4 and rear wall 8 are connected to base 2, as are left and right side walls 6, 10. According to a preferred embodiment, left and right sidewalls 6, 10 are formed at a predetermined angle of about 93.5° with respect to base 2, and as such, facilitate nesting of one or more bins 100 into one another, for purposes of storage. According to a preferred embodiment, front wall 4 and rear walls 8 are formed at a predetermined angle of about 93.5° with respect to base 2, and as such, facilitate nesting of one or more bins 100 into one another, for purposes of storage. Stacking feet 71, 80 located at the bottom and front of the left and right sidewalls 6, 10 fit into similar shaped stacking receptacles 74, 84 located at the front portions of the left and right sidewalls 6, 10. According to a preferred embodiment, bin 100 further comprises handle 16 that is freely rotatable through about 235°. Handle 16 can be substantially freely rotated from a bag storage position when located on upper portion 102 of rear wall 8 of bin 100, to a carrying position (substantially perpendicular to the top portion 102 of rear wall 8, and top portions 98, 96 of left and right sidewalls 6, 10) to a storage position (when located upon front wall 4, and surface 13). When handle 16 is located on upper portion 102 of rear wall 8 (bag storage position), the upper portion of handle 16 forms a substantially even upper surface that extends about right sidewall 10, rear wall 8 and left sidewall 6. When in the bag storage position, handle 16 assists in retaining one or more plastic bags or bin liners that can be used to keep bin 100 clean when storing recyclable materials. Located at the outer, bottom portion of rear wall 8 of bin 100 is a channel or groove 36 that when an upper bin 100' is stacked on a lower bin 100, fits over handle 16 when it is in the bag storage position. At the lower rear portion of rear wall 8 is rear wall lower lip 38 that extends over substantially the entire length of rear wall 8: according to a preferred embodiment, together groove 36 and lip 38 substantially prevent an upper bin 100' from moving front-wards or backwards in regard to a lower bin 100 when the two (or more) bins are stacked upon each other. According to further preferred embodiments, to further facilitate retention of a plastic bag or liner in bin 100 are a plurality of inverted "V" shaped liner retainers 78, 88; bags or liners fit within the inverted "V" and are essentially clamped into the narrow inverted "V" opening, substantially preventing the bag or liner 104 from inadvertently slipping into the interior of bin 100, thereby keeping liner 104 essentially in place. According to a preferred embodiment, when an upper bin 100' is stacked upon lower bin 100, the combination of the angle of base front upwardly sloping surface 34' of upper bin 100' (about 43.2° with respect to a plane of base 2 that extends outwardly and co-planarly from base 2), and the angle formed between upper surface right sidewall 96 and right sidewall front sloped portion 14 of about 50° (substantially the same angle is formed between upper surface left sidewall 98 and left sidewall front sloped portion 12), and the dimensions of base front upwardly sloping surface 34 allows recyclable objects or materials to be placed relatively easily into the interior storage space of lower bin 100 through recycling receiving chute 106.

II. Bin 100—General Description

A. Front Wall 4.

Figure 2:
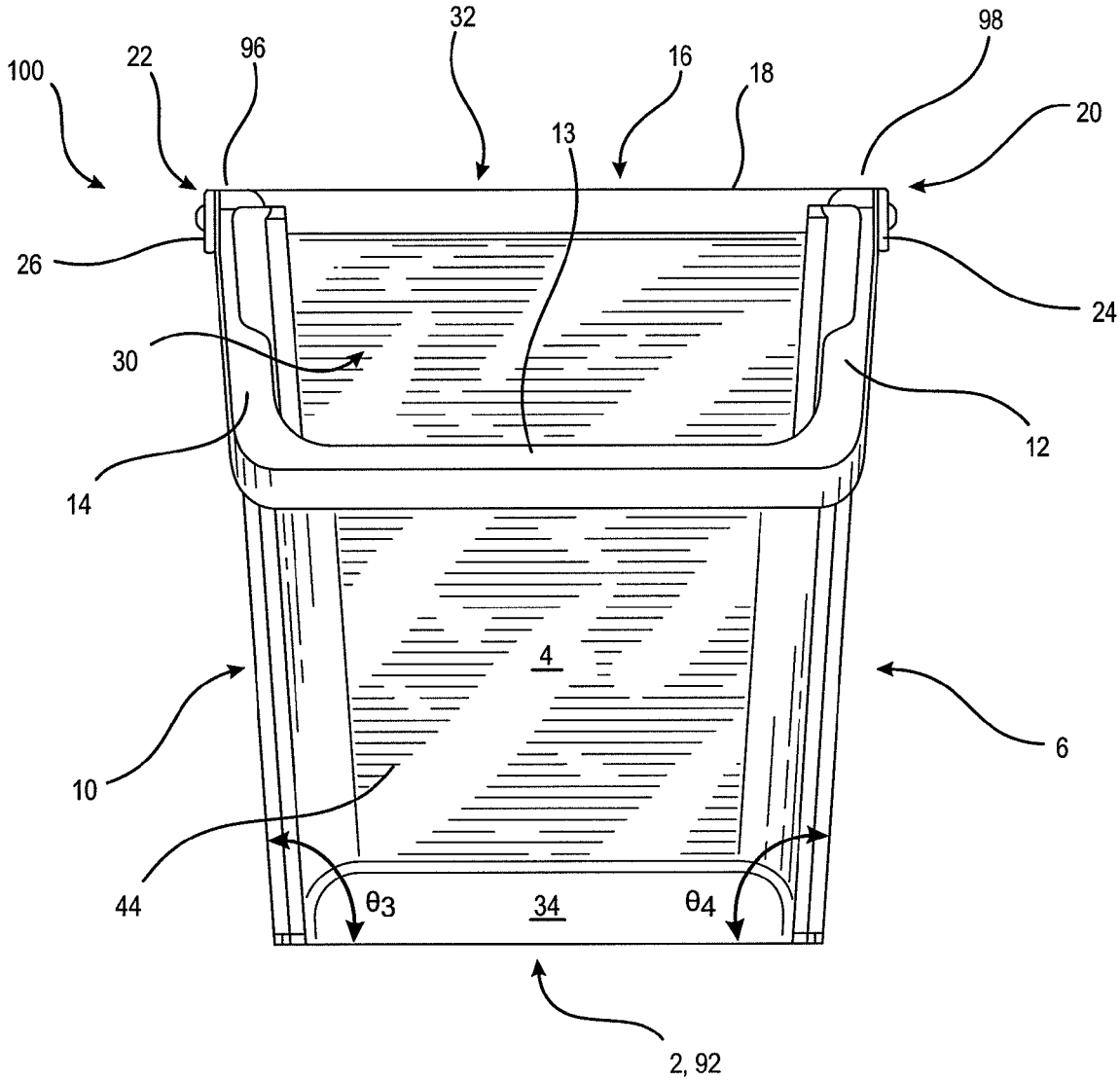
FIG. 2 illustrates a front view of the residential recycling bin as shown in FIG. 1.
Figure 3:
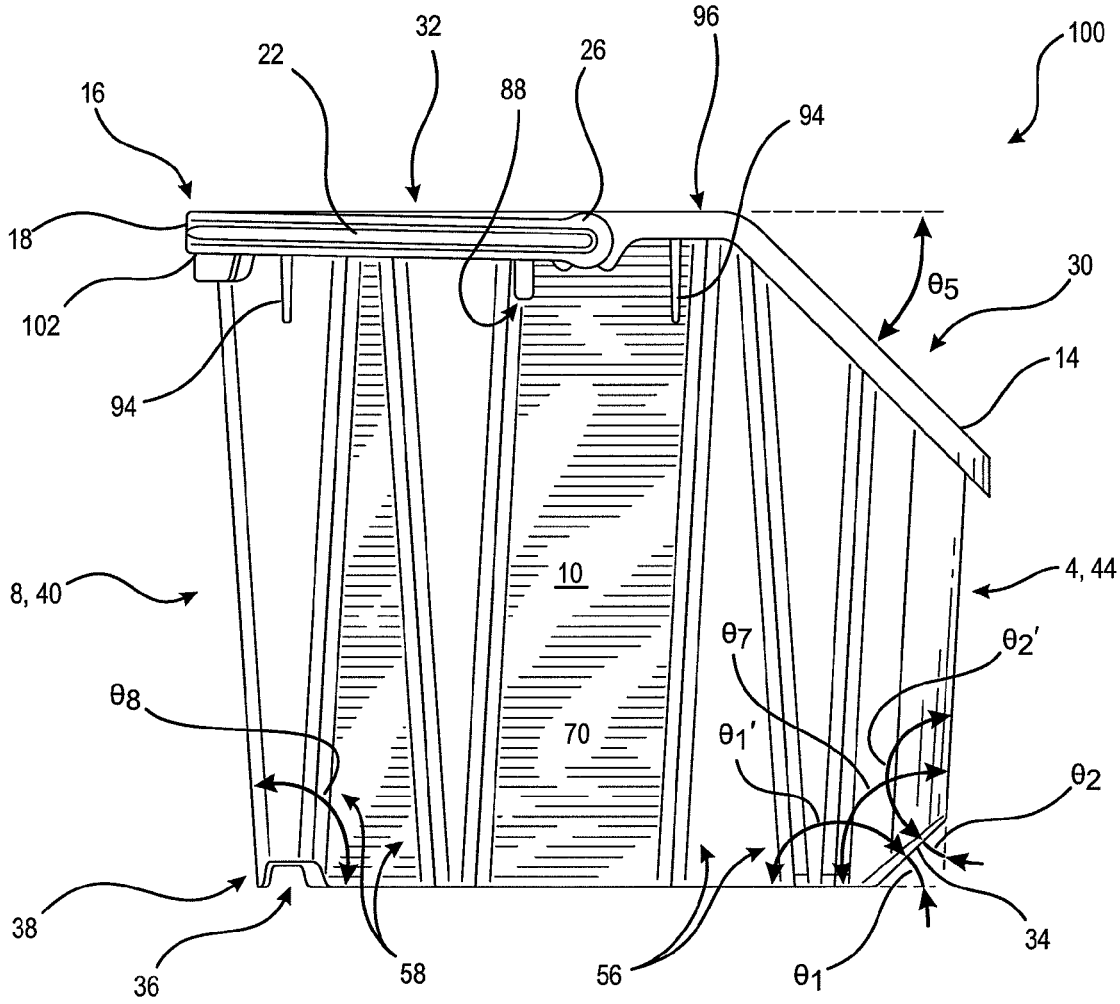
FIG. 3 illustrates a right side view of the residential recycling bin as shown in FIG. 1.
Figure 4:
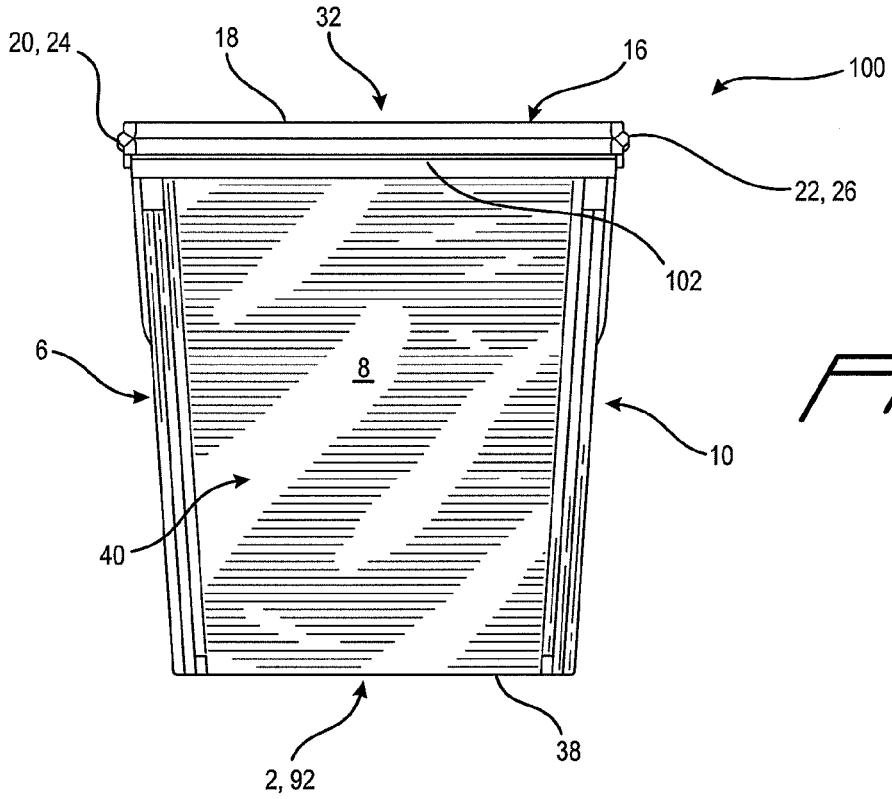
FIG. 4 illustrates a rear view of the residential recycling bin as shown in FIG. 1.

Referring to FIGS. 1 and 2, front wall 4 comprises a front wall outer surface 44 (outer surface), and a front wall inner surface 46 (inner surface). Front wall 4 is formed at a predetermined angle $\theta_7$ to base 2, and is joined to base 2, and left and right sidewalls 6, 10. According to an exemplary embodiment, front wall 4 is generally formed at a predetermined angle $\theta_7$ that ranges from about 92.5° to about 94.5° with respect to base 2. According to a further exemplary embodiment, front wall 4 is generally formed at the predetermined angle $\theta_7$ that ranges from about 93.3° to about 93.7° with respect to base 2. According to a preferred embodiment, front wall 4 is generally formed at the predetermined angle $\theta_7$ of about 93.5° with respect to base 2. On a lower portion of base 2 is upwardly sloping surface 34 that joins front wall 4 to base 2. According to an exemplary embodiment, as shown in FIG. 3, upwardly sloping surface 34 is formed at a first predetermined acute angle $\theta_1$ that ranges from about 42.2° to about 44.2° with respect to a plane of base 2 that extends outwardly and co-planarly from base 2 as shown in FIG. 1, and upwardly sloping surface 34 is formed at a second predetermined acute angle $\theta_2$ that ranges from about 46.8° to about 48.8° with respect to a plane of front wall 4 that extends outwardly and co-planarly from front wall 4 as shown in FIG. 1. According to a further exemplary embodiment, first predetermined angle $\theta_1$ ranges from about 43.0° to about 43.4° with respect to the plane of base 2 as described above, and upwardly sloping surface 34 is formed at the second predetermined angle $\theta_2$ that ranges from about 47.6° to about 48.0° with respect to the plane of wall 4 as described above. According to a preferred embodiment, upwardly sloping surface 34 is formed at the first predetermined angle $\theta_1$ of about 43.2° with respect to the plane base 2 as described above, and upwardly sloping surface 34 is formed at the second predetermined angle $\theta_2$ of about 47.8° with respect to the plane of front wall 4 as described above.

According to another exemplary embodiment, as those of ordinary skill in the art can appreciate, upwardly sloping surface 34 can also be said to be formed at an angle $\theta_{1'}$ with respect to base 2 itself, that ranges from about 135.8° to about 137.8°, and according to a further exemplary embodiment from about 136.6° to about 137°, and according to a preferred embodiment, $\theta_{1'}$ is about 136.8°.

According to still another exemplary embodiment, as those of ordinary skill in the art can appreciate, upwardly sloping surface 34 can also be said to be formed at an angle $\theta_{2'}$ with respect to front wall 4 itself, that ranges from about 131.2° to about 133.2°, and according to a further exemplary embodiment from about 132° to about 132.3°, and according to a preferred embodiment, $\theta_{2'}$ is about 132.2°.

Front wall 4 further comprises upper sloped surface 13. According to an exemplary embodiment, the height of upper sloped surface 13 above base 2 is different from upper surfaces 98, 96 of left sidewall 6 and right sidewall 10: left sidewall sloped surface 12 originates from upper surface 98 of left sidewall 6 to join upper sloped surface 13 of front wall 4, as does right sidewall sloped surface 14 (which originates from upper surfaces 96 of right sidewall 10), to form front opening 30, as shown in FIGS. 1, 2 and 3. As seen in FIG. 3, right sidewall sloped surface 14 is formed at an angle $\theta_5$ with respect to upper surface 96 of right sidewall 10. According to an exemplary embodiment, $\theta_5$ ranges from about 45° to about 55°. According to a further exemplary embodiment, $\theta_5$ ranges from about 47.5° to about 52.5°. According to a preferred embodiment, $\theta_5$ is about 50°. Left sidewall sloped surface 12 originates from and is similarly formed at an angle of $\theta_5$ with respect to upper surface 98 of left sidewall 6, with the same ranges in values as with right sidewall sloped surface 14 and upper surface 96 and right sidewall 10. According to a preferred embodiment, when placed in a stacked configuration, i.e., when an identical upper bin 100' is placed on lower bin 100, front opening 30 (see FIGS. 17-21) provides a means for users of bins 100 to place recyclable articles or materials within an interior space of bin 100.

B. Right Side Wall 10 and Left Side Wall 6.

Figure 5:
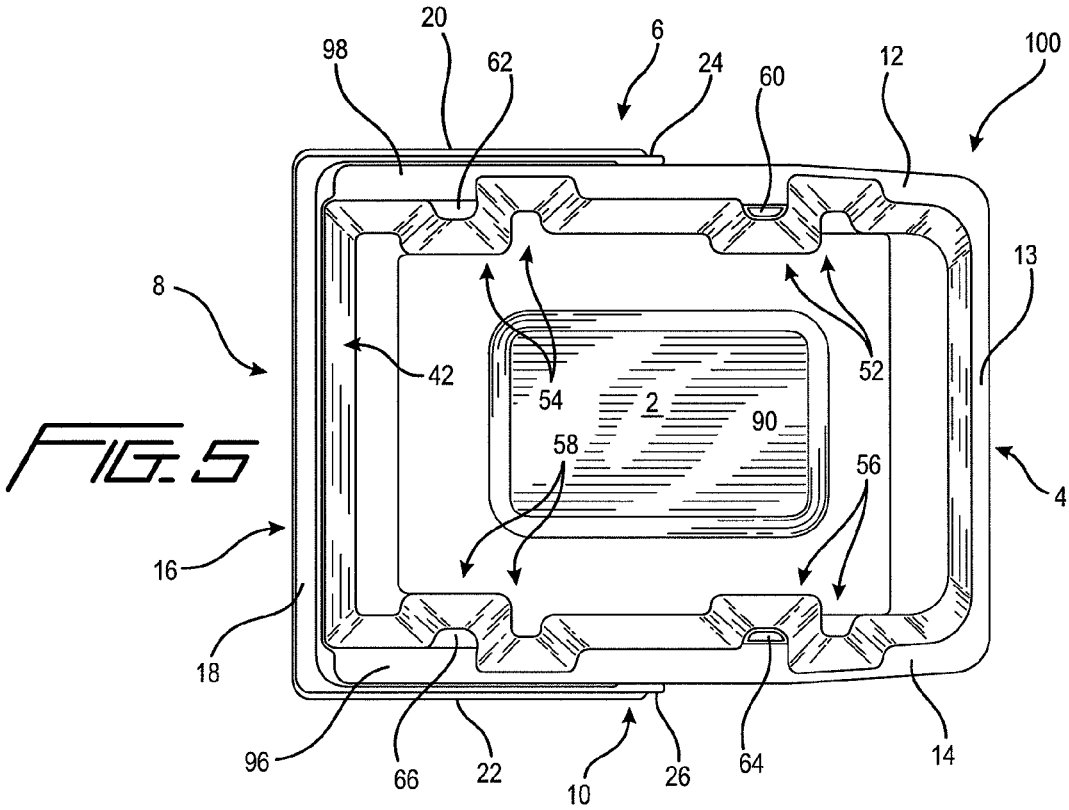
FIG. 5 illustrates a top view of the residential recycling bin as shown in FIG. 1.
Figure 6:
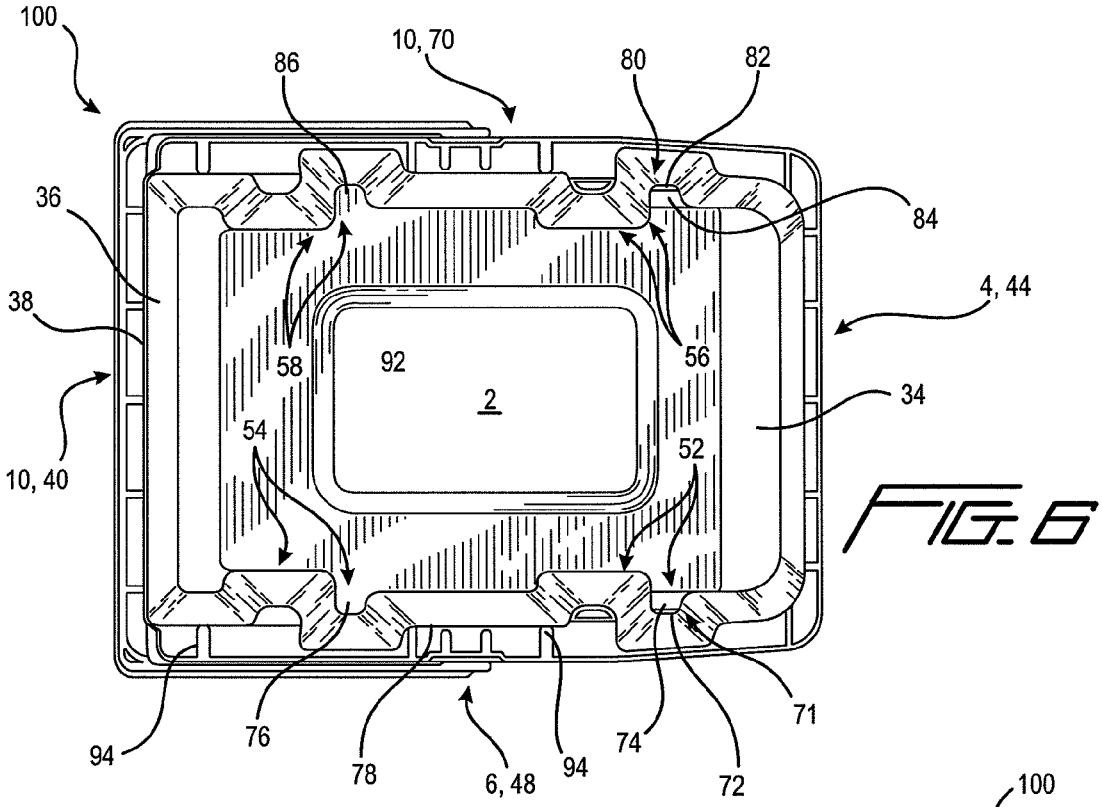
FIG. 6 illustrates a bottom view of the residential recycling bin as shown in FIG. 1.
Figure 7:
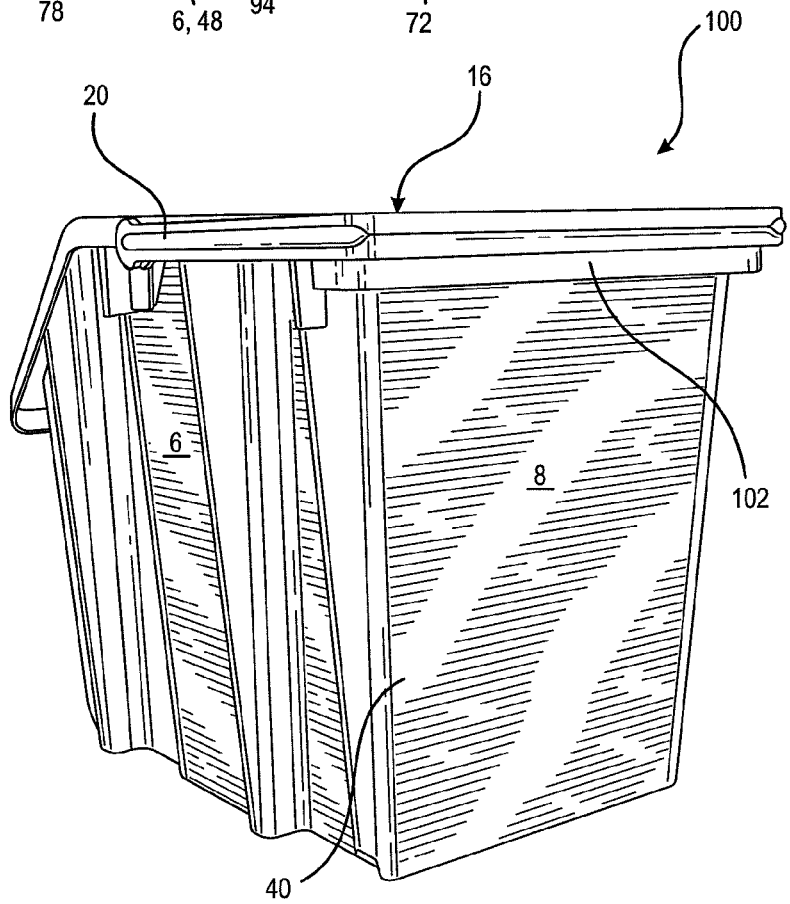
FIG. 7 illustrates a rear perspective view of the residential recycling bin as shown in FIG. 1.

As shown in FIGS. 1, 2, 5, 6, and 10, left sidewall 6 comprises an inner surface 50 and outer surface 48. According to an exemplary embodiment, left sidewall 6 is generally formed at a predetermined angle $\theta_4$ that ranges from about 92.5° to about 94.5° with respect to base 2. According to a further exemplary embodiment, left sidewall 6 is generally formed at the predetermined angle $\theta_4$ that ranges from about 93.3° to about 93.7° with respect to base 2. According to a preferred embodiment, left sidewall 6 is generally formed at the predetermined angle $\theta_4$ of about 93.5° with respect to base 2. According to still a further embodiment, left sidewall 6 comprises several stacking and nesting features that provide strength and rigidity to bin 100, as well as making it easier to nest or stack bins 100 within or on top of the other. Whereas front wall 4 and rear wall 8 are substantially flat planar surfaces, left sidewall 6 comprises a plurality of surfaces not planar to each other: this is the result of left sidewall 6 comprising a pair of stacking channels. As shown in FIGS. 1, 5, and 6, left sidewall 6 comprises front pair left sidewall stacking channels 52, and rear pair left sidewall stacking channels 54.

According to a preferred embodiment, as viewed from the left side of bin 100, each pair of stacking channels comprises a first channel and a second channel, wherein the first and second channels are inverted, substantially mirror versions of the other. Viewed from the top, the channels are generally shaped as a three dimensional "V" (or inverted "V"), but without the sharp angular terminating portion of the "V". As such, the combination of front pair left sidewall stacking channels 52, and rear pair left sidewall stacking channels 54 provides an undulating surface that is well known to those of ordinary skill in the art to provide significant strength to wall surfaces. Located at a lowermost portion of the front-most front pair left sidewall stacking channels 52 is left sidewall front stacking foot 71, which itself comprises left sidewall front stacking foot rib 72 and left sidewall front stacking foot recess 74. On the front-most channel of rear pair left sidewall stacking channels 54 is left sidewall rear stacking foot 76. A detailed discussion of the operation of left sidewall front stacking foot rib 72, left sidewall front stacking foot recess 74, and left sidewall rear stacking foot 76 is included below.

Figure 22:
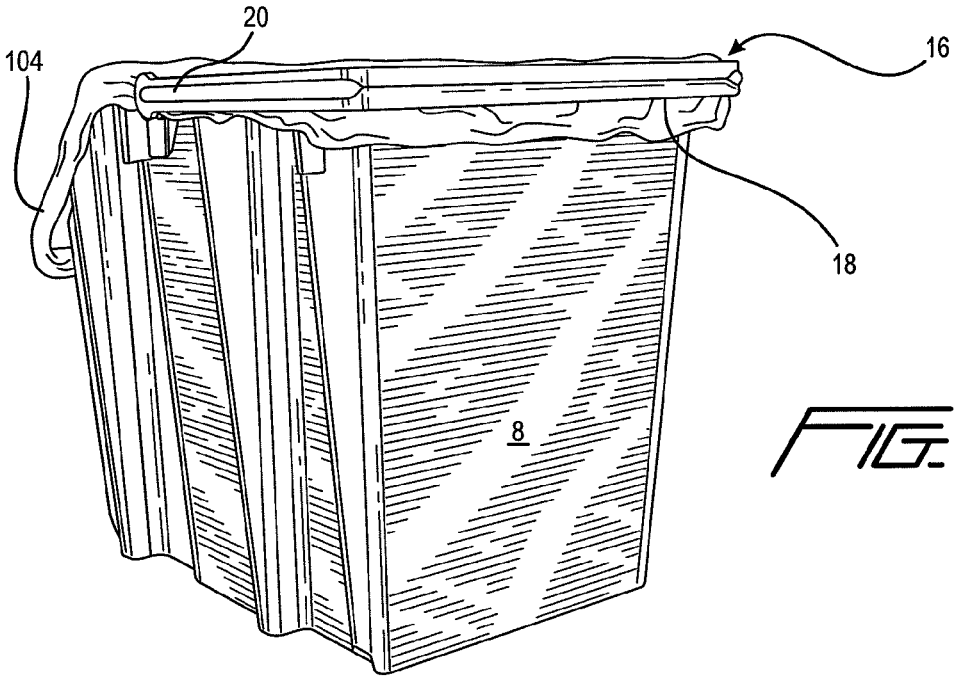
FIG. 22 illustrates a residential recycling bin as shown in FIG. 1 with the handle lowered and retaining a plastic bag, according to an embodiment of the present invention.
Figure 23:
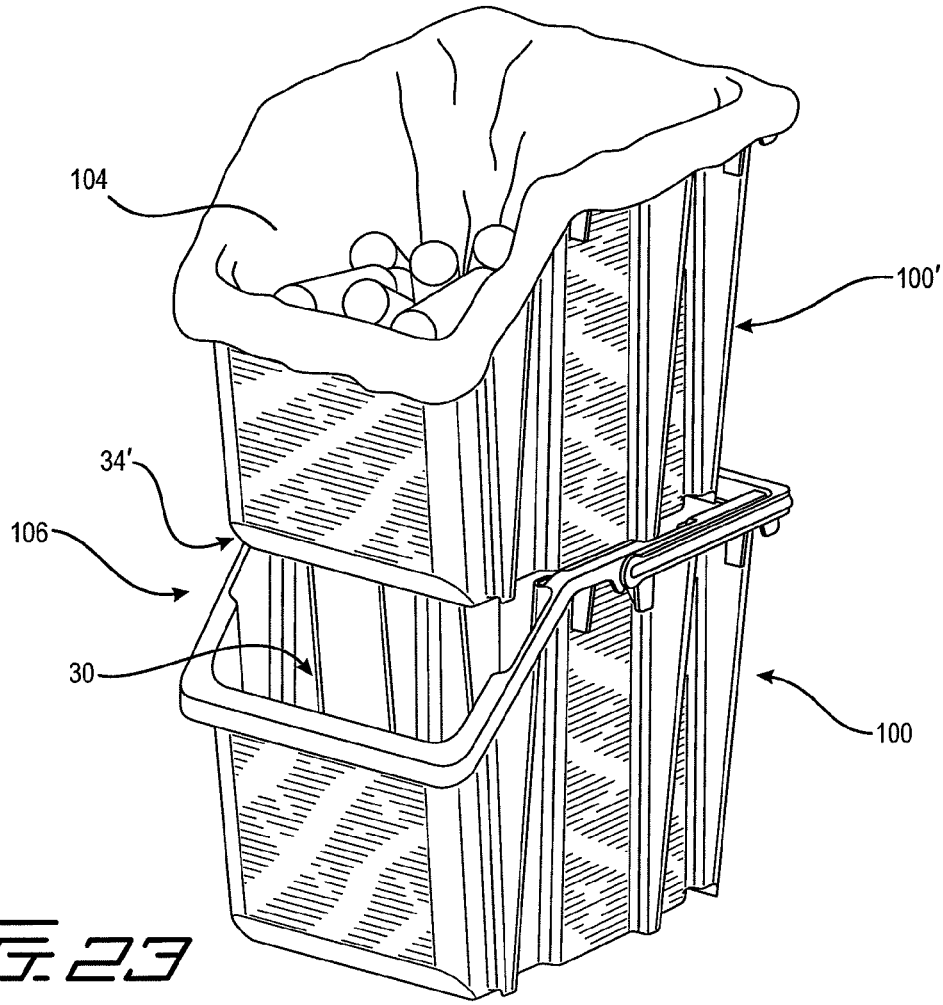
FIG. 23 illustrates first and second residential recycling bins, with bags containing recyclable materials, in a stacked configuration, according to an embodiment of the present invention.
Figure 24:
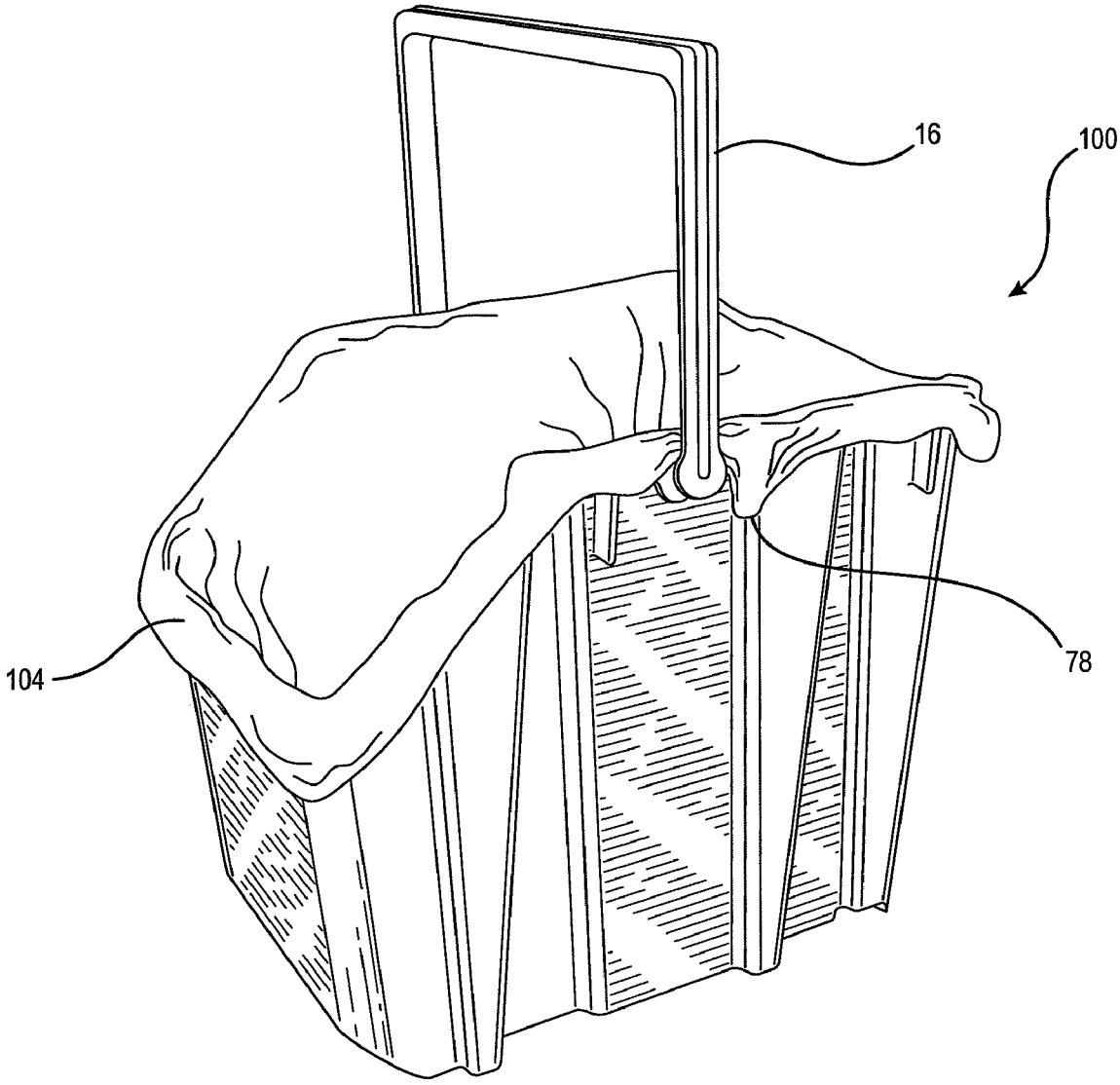
FIG. 24 illustrates a residential recycling bin, with a bag containing recyclable materials, with its handle in a raised condition such that the residential recycling bin can be relocated, according to an embodiment of the present invention.

Further included on left sidewall 6 is first inverted "V" shaped liner retainer 78. First inverted "V" shaped liner retainer 78 facilitates retention of a plastic bag, or liner, that can be placed in bin 100, as shown in FIGS. 22-24. Operation of first inverted "V" shaped liner retainer 78 is discussed in greater detail below.

As shown in FIGS. 1, 2, 3, 5, 6, 9, and 10, right sidewall 10 comprises an inner surface 68 and outer surface 70. According to an exemplary embodiment, right sidewall 10 is generally formed at a predetermined angle $\theta_3$ that ranges from about 92.5° to about 94.5° with respect to base 2. According to a further exemplary embodiment, right sidewall 10 is generally formed at the predetermined angle $\theta_3$ that ranges from about 93.3° to about 93.7° with respect to base 2. According to a preferred embodiment, right sidewall 10 is generally formed at the predetermined angle $\theta_3$ of about 93.5° with respect to base 2. Further still, according to a preferred embodiment, right sidewall 10 comprises several stacking and nesting features that provide strength and rigidity to bin 100, as well as making it easier to nest and stack bins 100 within or on top of the other. Whereas front wall 4 and rear wall 8 are substantially flat planar surfaces, right sidewall 10 comprises a plurality of surfaces not planar to each other: this is the result of right sidewall 10 comprising a pair of stacking channels. As shown in FIGS. 1, 3, 5, and 6, right sidewall 10 comprises front pair right sidewall stacking channels 56, and rear pair right sidewall stacking channels 58. As those of ordinary skill in the art can appreciate, predetermined angles $\theta_3$ and $\theta_4$ need not necessarily be the same angle.

According to a preferred embodiment, as viewed from the right side of bin 100, each pair of stacking channels comprises a first channel and a second channel, wherein the first and second channels are inverted, substantially mirror versions of the other. Viewed from the top, the channels are generally shaped as a three dimensional "V" (or inverted "V"), but without the sharp angular terminating portion of the "V". As such, the combination of front pair right sidewall stacking channels 56, and rear pair right sidewall stacking channels 58 provides an undulating surface that is well known to those of ordinary skill in the art to provide significant strength to wall surfaces. Located at a lowermost portion of the front-most front pair right sidewall stacking channels 56 is right sidewall front stacking foot 80, which itself comprises right sidewall front stacking foot rib 82, and right sidewall front stacking foot recess 84. On the front-most channel of rear pair left sidewall stacking channels 58 is right sidewall rear stacking foot 86. A detailed discussion of the operation of right sidewall front stacking foot rib 82, right sidewall front stacking foot recess 84, and right sidewall rear stacking foot 86 is included below.

Further included on right sidewall 10 is second inverted "V" shaped liner retainer 88. Second inverted "V" shaped liner retainer 88 is shown in a close up perspective view in FIG. 9. Second inverted "V" shaped liner retainer 88 operates with first inverted "V" shaped liner retainer 78 to facilitate retention of a plastic bag, or liner 104, that can be placed in bin 100, as shown in FIGS. 22-24. Operation of first and second inverted "V" shaped liner retainers 78, 88 are discussed in greater detail below.

C. Rear Wall 8.

As shown in FIGS. 1 and 3-8, rear wall 8 is substantially similar in construction to front wall 4, albeit of different dimensions. According to an exemplary embodiment, rear wall 8 is generally formed at a predetermined angle $\theta_8$ that ranges from about 92.5° to about 94.5° with respect to base 2. According to a further exemplary embodiment, rear wall 8 is generally formed at the predetermined angle $\theta_8$ that ranges from about 93.3° to about 93.7° with respect to base 2. According to a preferred embodiment, rear wall 8 is generally formed at the predetermined angle $\theta_8$ of about 93.5° with respect to base 2. Rear wall 8 comprises an inner surface 42 and outer surface 40, both of which are substantially planar. According to a preferred embodiment, located at a lowermost portion of rear wall 8 is rear wall lower lip 38, which operates with base rear groove 36 to substantially prevent movement of an upper bin 100' when stacked upon a lower bin 100: stacking of bins shall be discussed in greater detail below.

Figure 11:
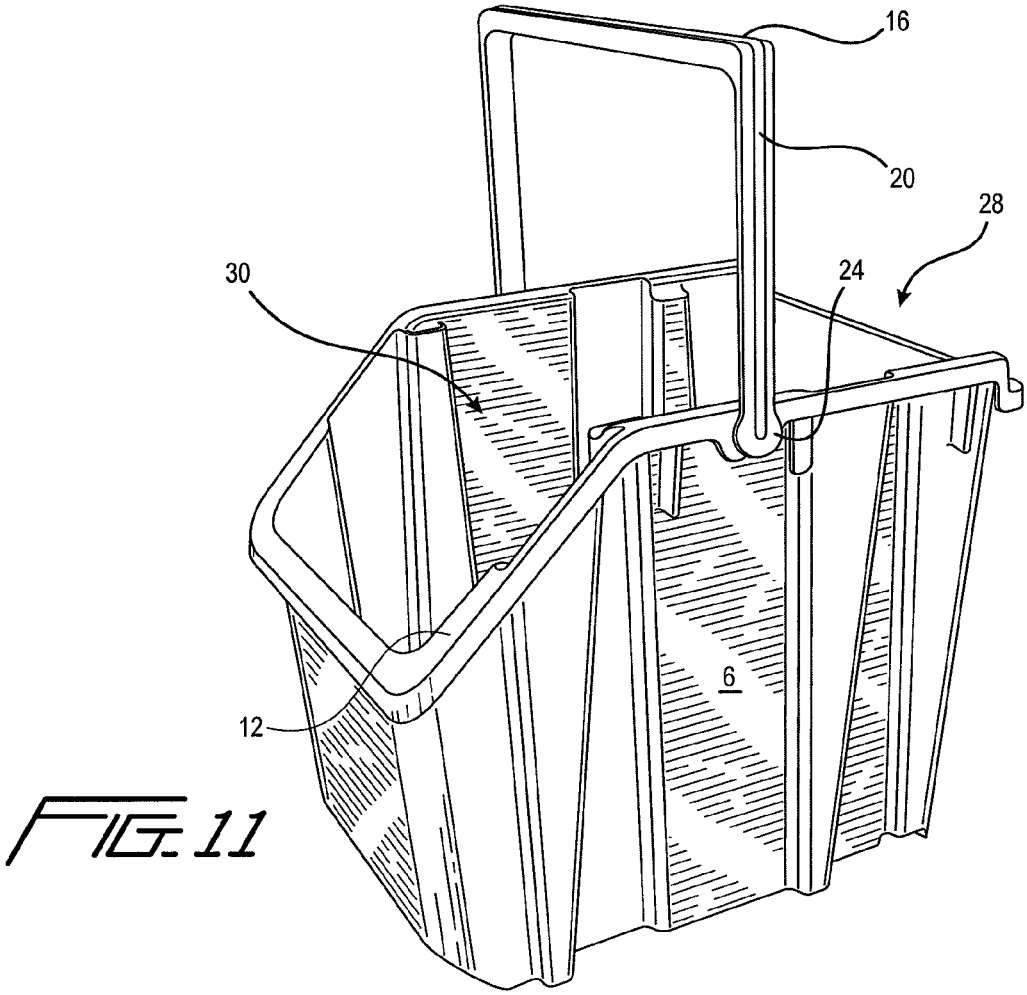
FIG. 11 illustrates a front perspective view of the residential recycling bin as shown in FIG. 1 with a handle in a raised condition.
Figure 12:
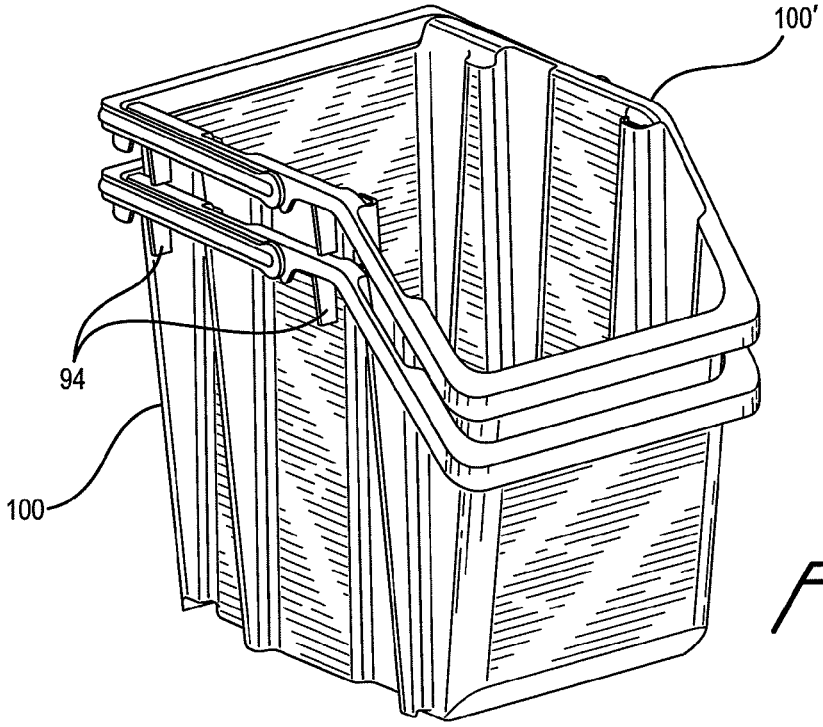
FIG. 12 illustrates a front perspective view of a first and second residential recycling bin in a nested configuration according to an embodiment of the present invention.
Figure 13:
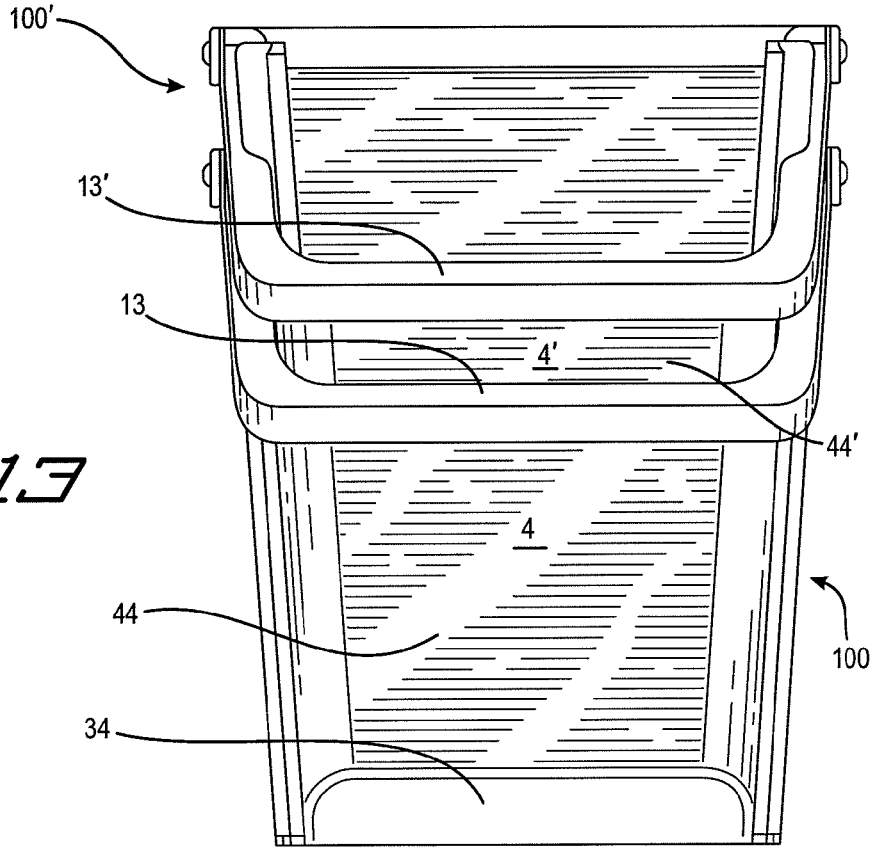
FIG. 13 illustrates a front view of the nested residential recycling bins as shown in FIG. 12.
Figure 14:
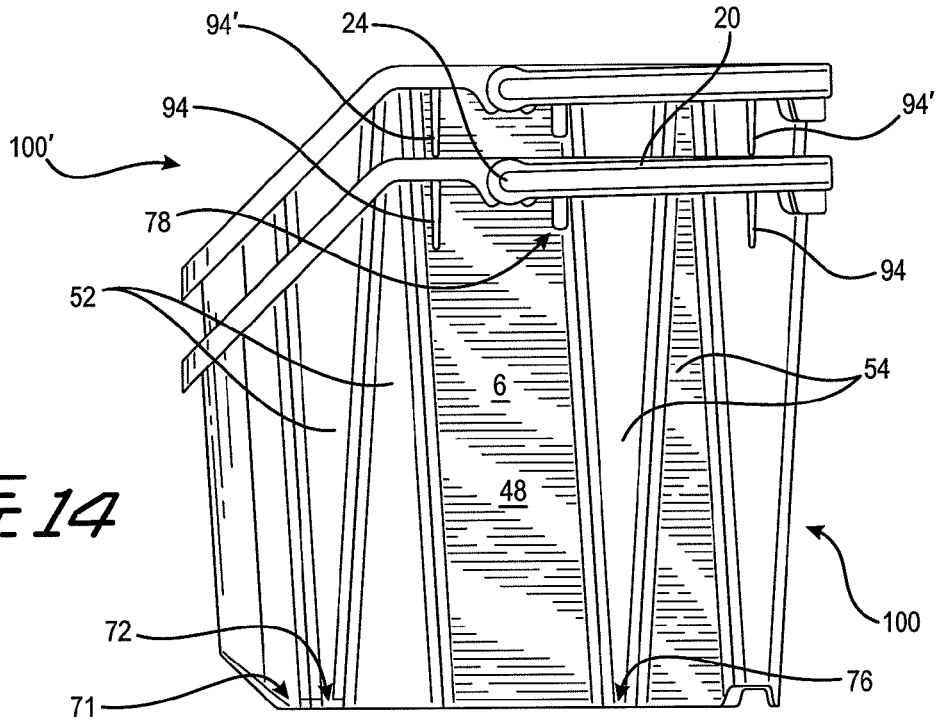
FIG. 14 illustrates a left side view of the nested residential recycling bins as shown in FIG. 12.
Figure 15:
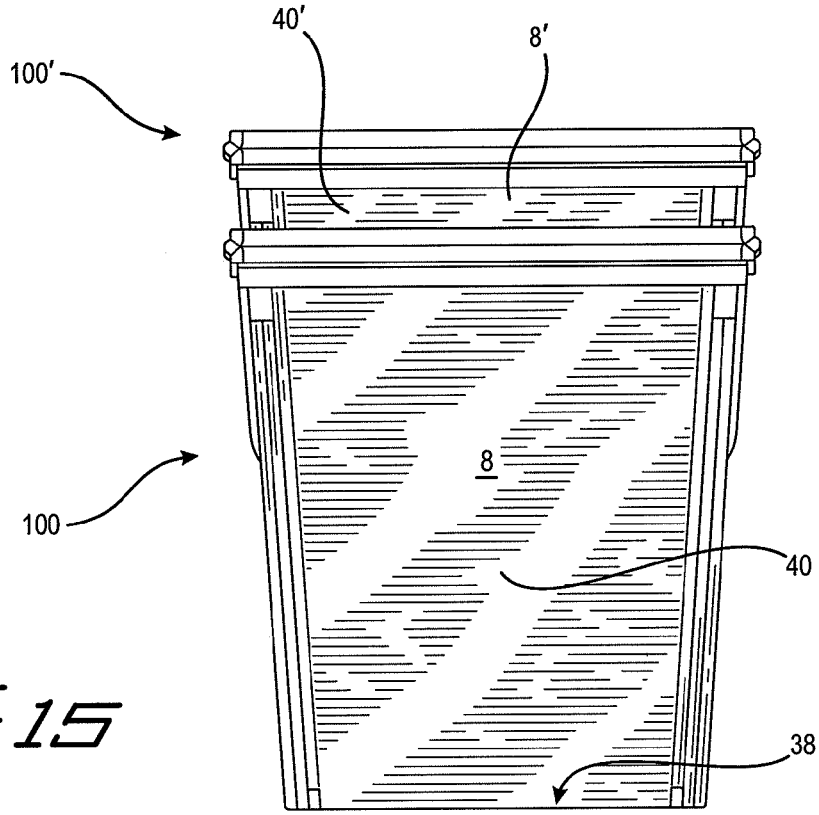
FIG. 15 illustrates a rear view of the nested residential recycling bins as shown in FIG. 12.
Figure 16:
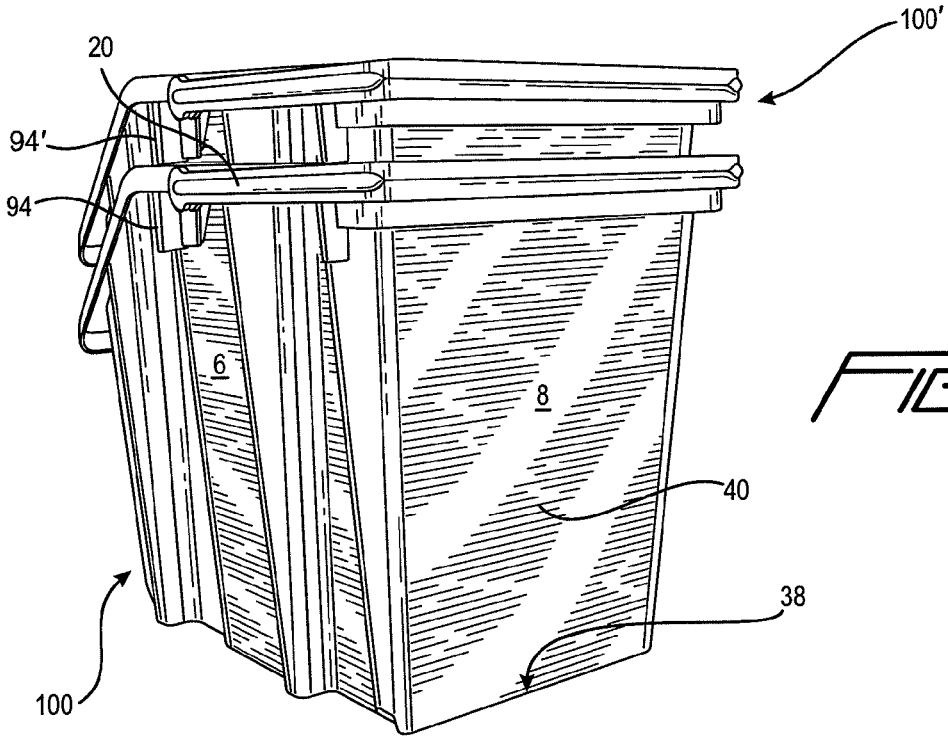
FIG. 16 illustrates a rear perspective view of the residential recycling bins as shown in FIG. 12.

Rear wall 8 further comprises rear wall top open portion 28 (see FIG. 11). According to a preferred embodiment, rear wall top open portion 28 is a space of specific dimensions that allows handle 16 to be positioned such that an upper portion of bag retention portion 18 of handle 16 is substantially aligned with upper portions 98, 96 of left and right sidewalls 6, 10, respectively. When bag retention portion 18 of handle 16 is located in rear wall top open portion 28 (as shown in FIG. 1), an upper portion of bag retention portion 18, upper surface left sidewall 98, and upper surface right sidewall 96 are substantially planar.

D. Base 2.

Base 2, as shown in FIGS. 3-6, comprises an upper surface 90, and lower surface 92, both of which are substantially planar. Referring to FIG. 6, in particular, it can be seen that base 2 comprises a lower surface of left sidewall stacking foot 76, and a lower surface of right sidewall stacking foot 86. According to a preferred embodiment, located at a rear of base 2 is rear groove 36, which, as briefly discussed above, and in greater detail below, fits over handle 16 when an upper bin 100' is stacked upon lower bin 100, to substantially prevent front-wards or backwards motion. According to a preferred embodiment, a front portion of base 2 translates into base front upwardly sloping surface 34 at a predetermined angle of about 43.2° with respect to a plane of base 2 that extends outwardly and co-planarly from base 2, as described in detail above.

III. Bin 100—Nested Configuration

FIGS. 12-16 show upper bin 100' nested within lower bin 100 according to an exemplary embodiment. As those of ordinary skill in the art can appreciate, nesting an upper bin 100' within lower bin 100 saves space when bins 100 are not in use holding and/or transporting recyclable materials. There are a plurality of stacking ribs 94 on both left sidewall 6 and right sidewall 10 that help prevent upper bin 100' from being wedged into lower bin 100 in the nesting configuration. Stacking ribs 94' of upper bin 100' rest upon upper surface left sidewall 98 and upper surface right sidewall 96. Since stacking ribs 94', and 94 are aligned with each other when upper bin 100' is nested within lower bin 100, the combination of the relatively wide, flat surface of upper surface left sidewall 98 and upper surface right sidewall 96 and stacking ribs 94 provide a substantially strong surface to dissipate the weight of multiple upper bins 100', or one or more upper bins 100' that might have some objects within them.

For example, although each bin 100 is relatively light, if 20 or 30 bins 100 were stacked as shown in FIGS. 12-16, the cumulative weight could wedge the lowermost bins 100 into each other, causing damage and/or bins 100 to be stuck within each other. In the nesting configuration, front pair left sidewall stacking channels 52' of upper bin 100' fit within front pair left sidewall stacking channels 52 of lower bin 100, as so the other stacking channels (54, 56, and 58). According to a preferred embodiment, in the nesting configuration, bins 100' and 100 achieve a space savings ratio of about 6:1, or about 84% according to an exemplary embodiment.

IV. Bin 100—Stacked Configuration

Figure 17:
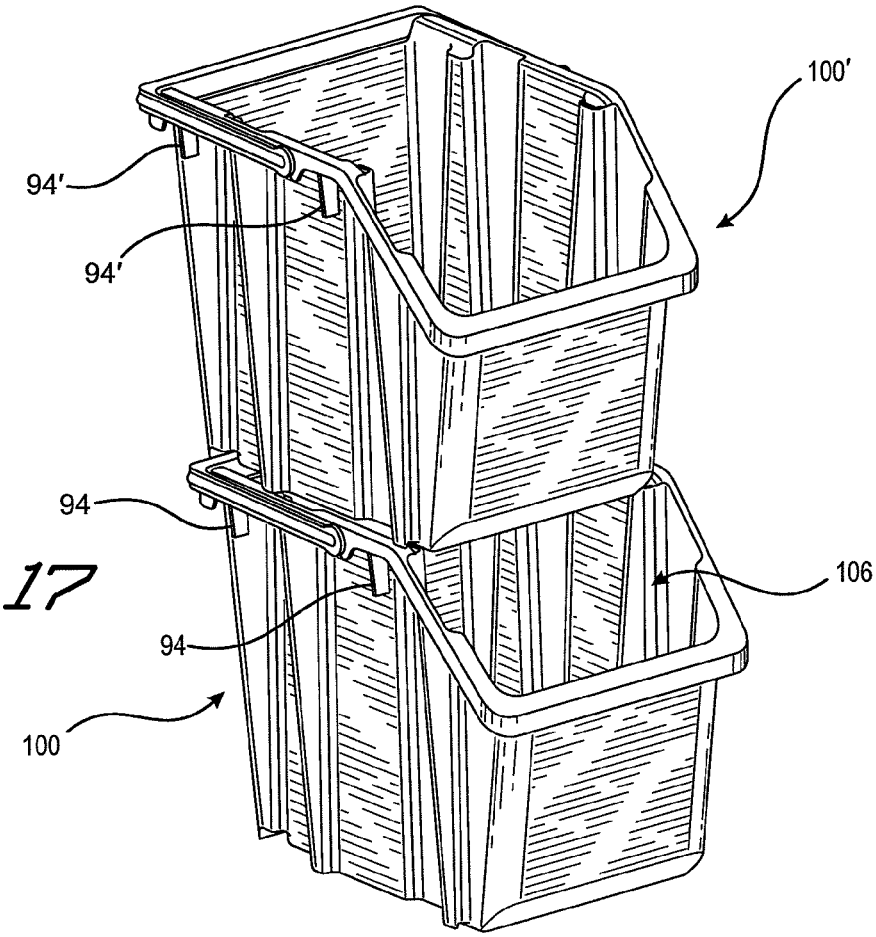
FIG. 17 illustrates a front perspective view of a first and second residential recycling bin in a stacked configuration according to an embodiment of the present invention.
Figure 18:
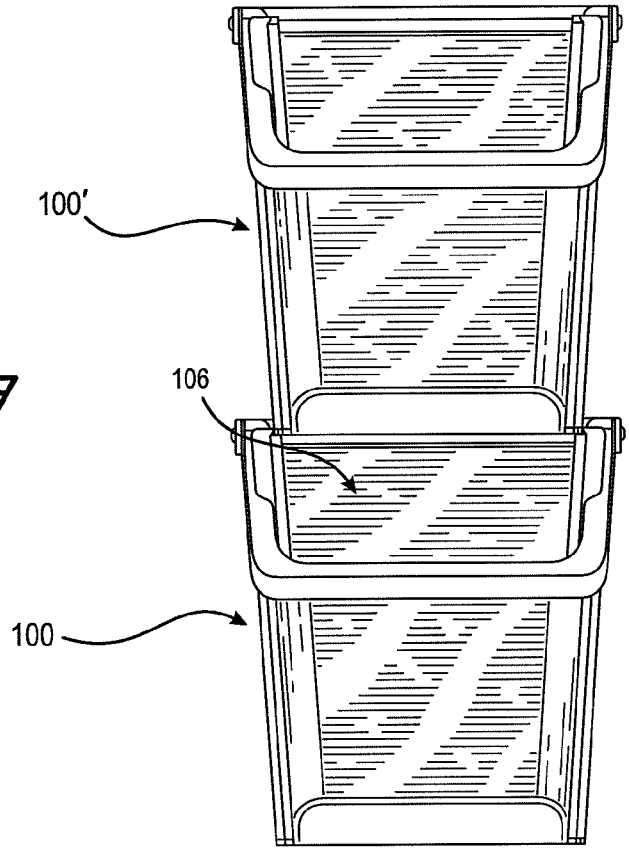
FIG. 18 illustrates a front view of the stacked residential recycling bins as shown in FIG. 17.

Attention is now directed to FIGS. 8-10, and 17-24, which show various features of bin 100 according to exemplary embodiments of the stacking or stacked configuration. As discussed in detail above, bin 100 is designed primarily for residential use, preferably in an apartment or townhouse setting, where space is at a premium, so that its inhabitants can efficiently store recyclable materials. FIG. 17 illustrates an upper bin 100' stacked upon lower bin 100. Generally, recyclable materials comprise two distinct groups: hard objects, such as glass, plastics and metals; and soft objects, such as paper products. Therefore, according to a preferred embodiment, users of bin 100 will preferably have a first and second bin 100 for such uses. Accordingly, inhabitants of the condo and/or townhouse will keep the two bins 100 stacked upon each other as shown in FIG. 17 in a kitchen or bathroom, for example, for storing the recyclable materials until it is time to transport them to another location for proper collection and disposal. Of course, as well known to those of ordinary skill, more than two bins 100 can be stacked on top of each other, or separate stacking pairs can of course be used to store even more recyclable materials.

Referring to FIGS. 17-21, upper bin 100' is stacked upon lower bin 100. According to an exemplary embodiment, there is preferably a single stacking configuration, which is known to those of ordinary skill in the art as the 0° stacking configuration, i.e., the front of upper bin 100' faces the same direction as the front of lower bin 100. As discussed in greater detail below, when placed in the 0° stacking configuration, several benefits are achieved as a result of the unique design and functionality of bins 100. To stack upper bin 100' upon lower bin 100, a user will locate the stacking feet of upper bin 100' onto stacking feet receptacles of lower bin 100. Specifically, a user of bins 100', 100 will place left sidewall front stacking foot 71' of upper bin 100' onto left sidewall stacking receptacle 60 of lower bin 100; right sidewall front stacking foot 80' of upper bin 100, onto right sidewall stacking receptacle 64 of lower bin 100; left sidewall rear stacking foot 76' of upper bin 100' onto left sidewall stacking ledge 62 of lower bin 100; and right sidewall rear stacking foot 86' of upper bin 100' onto right sidewall stacking ledge 66 of lower bin 100.

Figure 10:
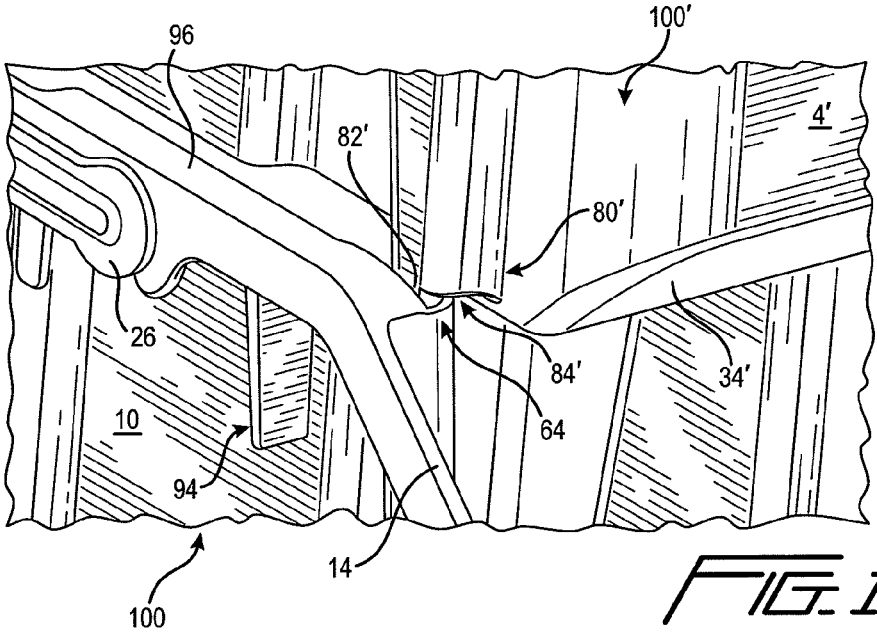
FIG. 10 illustrates a close-up right side perspective view of a first bin and a second bin in a stacked configuration, including a stacking foot of the upper bin located in a stacking recess of the lower bin, according to an embodiment of the present invention.

When so stacked, upper bin 100', according to an exemplary embodiment, is substantially prohibited from frontwards and backwards movement with respect to lower bin 100 through several exemplary features of the different embodiments. Each of the left and right front sidewall stacking feet 71', 80' comprise a stacking foot rib and recess, which fit into and over, the front stacking foot receptacles of lower bin 100. Referring now to FIG. 10, right sidewall front stacking foot 80' of upper bin 100' has been placed on right sidewall stacking foot receptacle 64 of lower bin 100. Right sidewall front stacking foot 80' comprises right sidewall front stacking foot rib 82' that fits into right sidewall stacking receptacle 64 of lower bin 100, and right sidewall front stacking foot recess 84 fits over the wall that is formed as part of right sidewall stacking receptacle 64 of lower bin 100. Since the same applies for the left sidewall stacking foot and receptacle, a detailed description thereof will be omitted for the purpose of brevity and clarity.

Located at the rear of upper and lower bins 100', 100, are two additional stacking feet and ledges. As best seen and shown in FIGS. 1, 5, and 6, left sidewall rear stacking foot 76' of upper bin 100' is placed onto left sidewall stacking ledge 62 of lower bin 100, and right sidewall rear stacking foot 86' of upper bin 100' is placed onto right sidewall stacking ledge 66 of lower bin 100. Since the same applies for the left sidewall stacking foot and receptacle, a detailed description thereof will be omitted for the purpose of brevity and clarity. Thus, the combination of stacking feet, receptacles, and ledges, and their association with the plurality of stacking channels, yields a significant strong stacking capability for bin 100.

Figure 8:
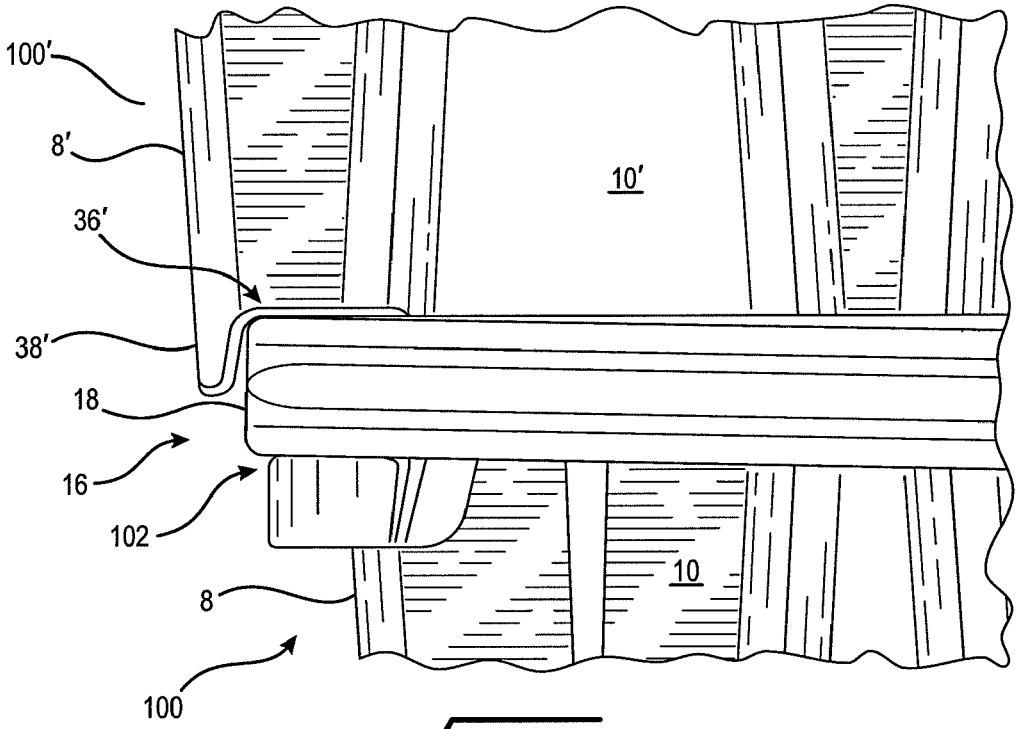
FIG. 8 illustrates a close-up right side view of rear portions of a first bin and a second bin in a stacked configuration, including a bag retaining handle of the lower bin, and a rear wall lower lip and handle groove of the upper bin, according to an embodiment of the present invention.
Figure 9:
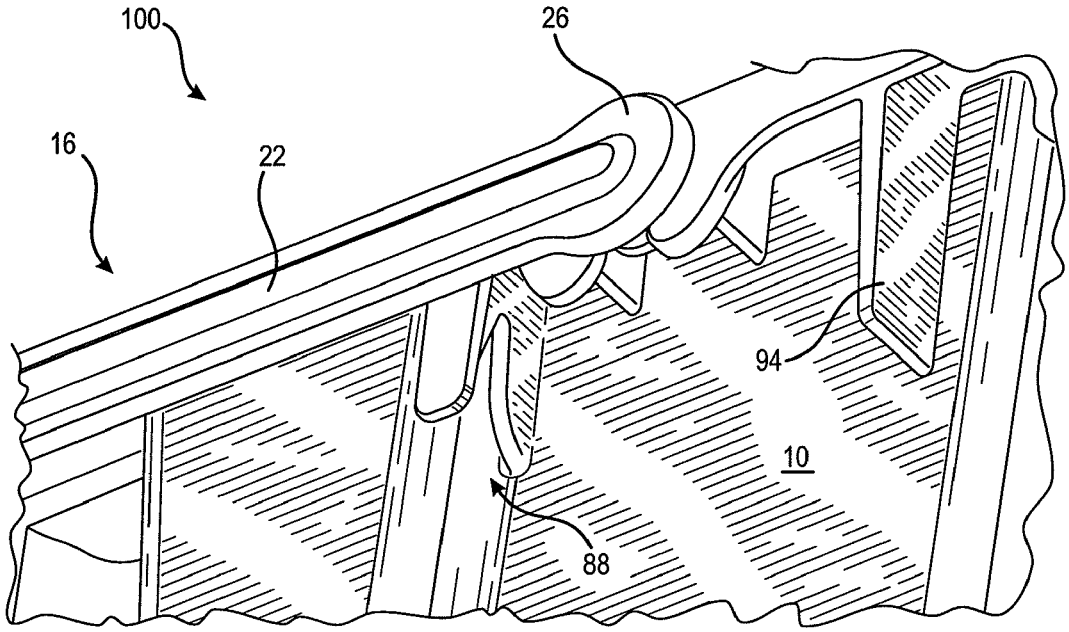
FIG. 9 illustrates a close-up right side perspective view of the bin shown in FIG. 1, including an inverted "V" shaped liner retainer, according to an embodiment of the present invention.

According to another exemplary embodiment, an additional inventive feature further prohibits unwanted motion and/or movement of upper bin 100' in regard to lower bin 100 as well as adding significant stacking strength. Referring to FIG. 8, handle 16 is located at the top of rear wall 8, in rear wall top open portion 28, which is a space created in rear wall 8 for the placement of handle 16. Handle 16 comprises several component sections, as shown in FIGS. 1, 3, 4, and 5: first arm portion 20, which is rotatably connected to left sidewall 6 via first rotatable mounting portion 24; second arm portion 22, which is rotatably connected to right sidewall 10 via second rotatable mounting portion 26; and bag retention portion 18, which comprises an upper surface, among others, and which is connected at a first end to first arm portion 20, and at a second end to second arm portion 22. Because handle 16 is rotatably attached to bin 100 at left and right sidewalls 6, 10 via first and second rotatable mounting portions 24, 26, according to an exemplary embodiment, handle 6 can freely and easily rotate through an angle of about 235°.

When handle 16 is placed on upper surface rear wall 102 of rear wall 8 at rear wall top open portion 28, which can also be referred to as the bag retention position, the upper surface of bag retention portion 18 of handle 16 forms a substantially smooth, nearly continuous upper surface at the uppermost locations of left sidewall 6, rear wall 8, and right sidewall 10. That is, according to an exemplary embodiment, upper surface left sidewall 98, upper surface right sidewall 96, and the upper surface of bag retention portion 18 of handle 16 forms a substantially smooth planar surface.

As shown in FIG. 8, according to a preferred embodiment, bin 100 further comprises base rear groove 36 and rear wall lower lip 38, which aid in preventing unwanted movement or motion of upper bin 100' in regard to lower bin 100. When stacked upon lower bin 100, base rear groove 36' and rear wall lower lip 38' of upper bin 100' fit over bag retention portion 18 of handle 16 of lower bin 100. Groove 36' and lip 38' are substantially parallel to, and extend over substantially the exterior width of, rear wall 8, thereby providing an exceptionally strong fit about handle 16 and the bag retention portion 18.

Bin 100 is preferably used to store and transport recyclable materials; as discussed above, these can include metals, glass, and paper products, such as newspapers. Glass and paper products, especially newspapers, can weigh a great deal relative to the weight of the plastic that bin 100 is made of. Nonetheless, several design features enhance the strength of bin 100 according to exemplary. As discussed above, when stacked, upper bin 100' is placed over lower bin 100 such that left sidewall front stacking foot 71' of upper bin 100' is placed onto left sidewall stacking receptacle 60 of lower bin 100; right sidewall front stacking foot 80' of upper bin 100' is placed onto right sidewall stacking receptacle 64 of lower bin 100; left sidewall rear stacking foot 76' of upper bin 100' is placed onto left sidewall stacking ledge 62 of lower bin 100; and right sidewall rear stacking foot 86' of upper bin 100' is placed onto right sidewall stacking ledge 66 of lower bin 100. Both the left sidewall front stacking foot 71' of upper bin 100' and left sidewall stacking receptacle 60 are formed as part of front pair left sidewall stacking channels 52, according to a preferred embodiment. As discussed above, the channels are created as part of left sidewall 6 as undulating surfaces, and as such, strengthen and increase the weight carrying capabilities of bin 100. Weight from recyclable materials in upper bin 100 is transferred though stacking feet 71', 76', 80', and 86' of upper bin 100' through channels 52, 54, 56, 58 of lower bin 100, to whatever surface lower bin 100 is resting upon (or another bin 100). The walls that form channels 52, 54, 56, 58 are formed at or about right angles to the interior and exterior surfaces of the left and right sidewalls 6, 10, although, as discussed above, the channels themselves are generally "V" shaped and thus the channel walls are formed at different angles with respect to base 2, which is substantially planar.

V. Use of Bin 100

According to an exemplary embodiment, bins 100 can be used to store and transport recyclable materials. Attention is directed towards FIGS. 9, 11, 19, and 22-24. As any who have dealt with recyclable materials can attest to, people generally do not thoroughly clean, if at all, the recyclable materials prior to their being recycled. Obviously, cleaning uses water, which is somewhat counter-productive in regard to the concept of recycling, and water, although not expensive, does cost money, and people are generally reluctant to spend money on what is essentially trash. However, nearly everyone involved in handling recyclable materials does understand that because the materials are not always properly cleaned, whatever food stuff or other items that might have been stored therein can cause rodent and/or insect infestation. Therefore, people will generally use plastic or paper bags as liners for containers that store recyclable materials, changing them from time-to-time. FIG. 24 shows inventive bin 100 according to an exemplary embodiment with handle 16 in a carrying position, and wherein liner 104 has been inserted into bin 100.

Liner 104, as shown in FIGS. 22-24, has been placed over and into first and second inverted "V" liner retainers 78, 88 according to an exemplary embodiment. The inverted "V" shape of first and second inverted "V" liner retainers 78, 88 retains liner 104, and substantially prevents it from being pulled into the interior of bin 100. Preferably, liner 104 also fits over the uppermost portion of rear wall 8 and rear wall open portion 28, as shown in FIG. 22, so that handle 16 fits over liner 104, also keeping it in place and substantially preventing it from being pulled into the interior of bin 100. Bag retention portion 18 of handle 16 fits into rear wall open portion 28, clamping down onto liner 104. When upper bin 100' is placed on top of lower bin 100, the weight of upper bin 100', and its contents, further facilitate retention of liner 104 in lower bin 100, further substantially preventing liner 104 from being pulled into the interior of bin 100. According to exemplary embodiments, the combination of first and second inverted "V" liner retainer 78, 88 and bag retention portion 18 of handle 16, when placed in the rear wall open portion 28, substantially prevents liner 104 from being pulled into the interior of bin 100, thereby avoiding messes and unnecessary cleaning of bin 100 according to an exemplary embodiment.

Figure 19:
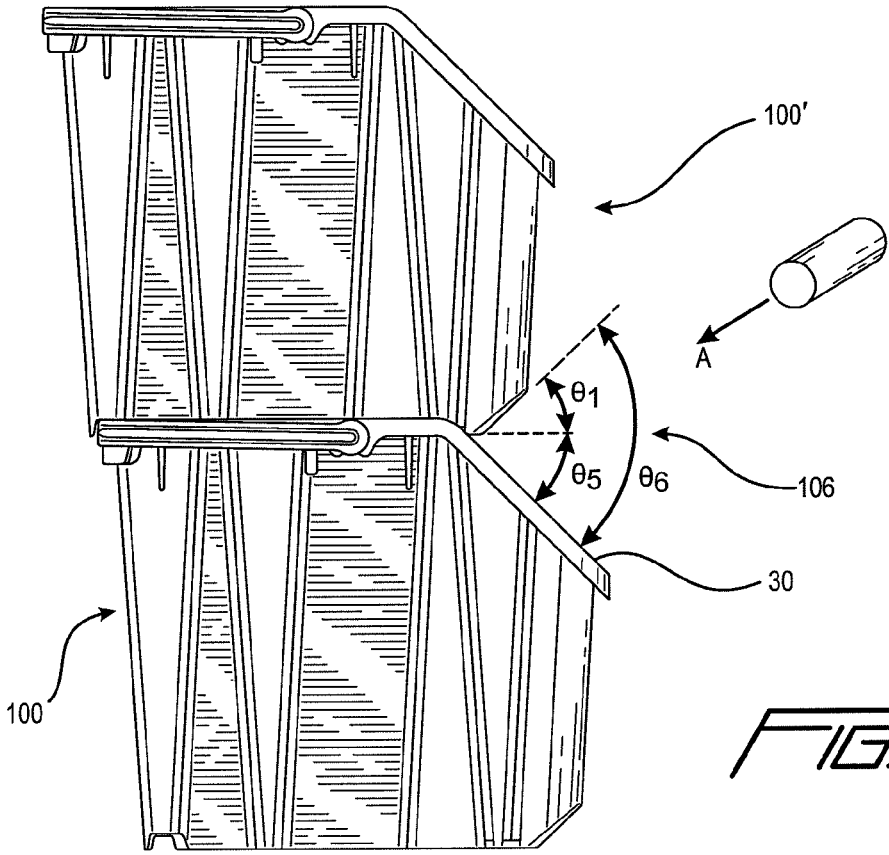
FIG. 19 illustrates a left side view of the stacked residential recycling bins as shown in FIG. 17.
Figure 20:
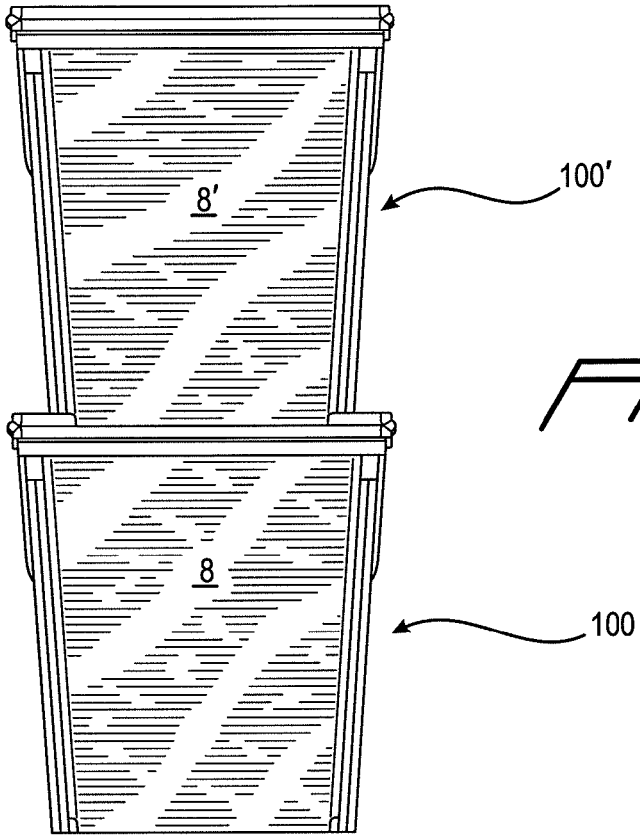
FIG. 20 illustrates a rear view of the stacked residential recycling bins as shown in FIG. 17.
Figure 21:
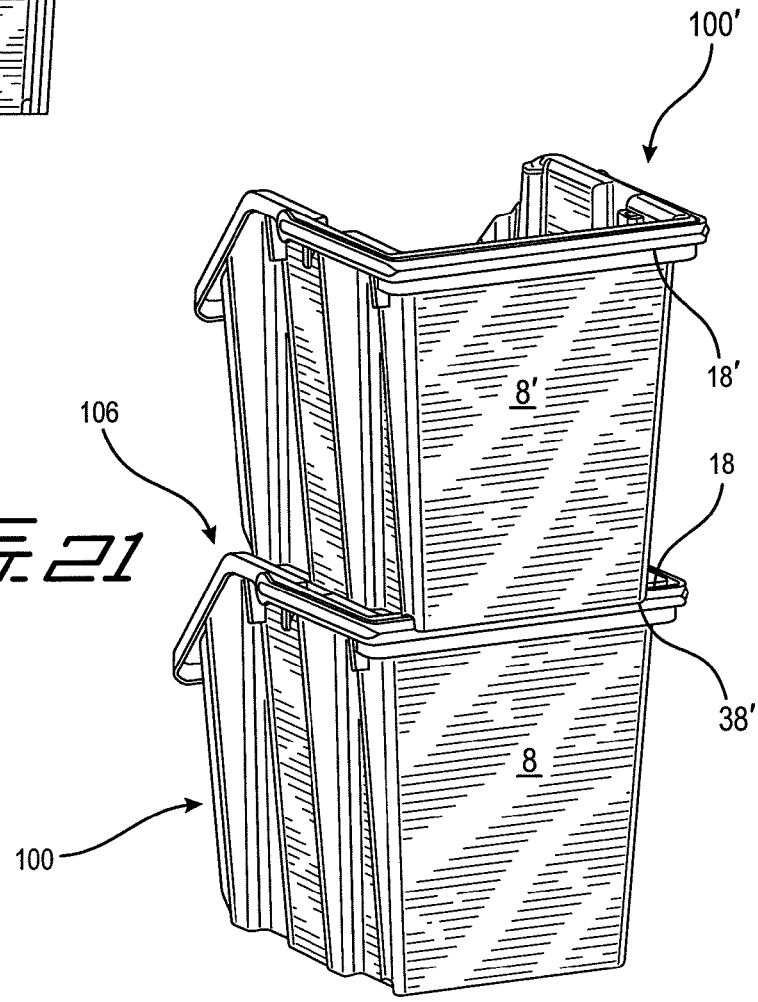
FIG. 21 illustrates a rear perspective view of the stacked residential recycling bins as shown in FIG. 17.

FIGS. 17, 19, and 23 illustrate upper bin 100' and lower bin 100' liners 104 in a stacked configuration, according to an exemplary embodiment. Bin 100 contains additional exemplary features that enable it to be more easily used to store and transport recyclable materials than those container found in the prior art. As discussed above, bin 100 comprises base front upwardly sloping surface 34, which, according to a preferred embodiment, is formed at an angle $\theta_1$ of about 43.2° with respect to the plane of base 2 that extends outwardly and co-planarly, as described in detail above. Further, opening 30 is defined by angle $\theta_5$ between upper surfaces 98, 96 of left sidewall 6 and right sidewall 10, and right sidewall sloped surface 14 and left sidewall sloped surface 12, respectively, as discussed above. Angle $\theta_5$ ranges from about 45° to about 55°, and preferably is about 50°. According to an exemplary embodiment, therefore, an angle $\theta_6$ is formed between the lower surface of base front upwardly sloping surface 34 and left sidewall front sloped surface 12 and right sidewall sloped surface 14, that ranges from about 87.2° to about 99.2°. According to a further exemplary embodiment, angle $\theta_6$ ranges from about 90.2° to about 96.2°. According to a preferred embodiment, angle $\theta_6$ is preferably about 93.2°. When upper bin 100' is stacked upon lower bin 100, as shown in FIGS. 17, 19, and 23, opening 30 of lower bin 100 forms a chute, or aperture with the space created by base front upwardly sloping surface 34. The aperture or recyclable receiving chute 106 receives recyclable materials as shown in FIGS. 19 and 23. The can moves in the direction of arrow A to enter recyclable receiving chute 106 and be deposited into the interior portion of lower bin 100.

According to a preferred embodiment, the combination of the angle that base front upwardly sloping surface 34' of upper bin 100' is formed at (about 43.2°), and the dimensions of base front upwardly sloping surface 34, allows recyclable objects or materials to be placed relatively easily into the interior storage space of lower bin 100. If base 2' of upper bin 100' were not formed with base front upwardly sloping surface 34, and instead front wall 4' extended downwardly till it met with base 2, at or about a right angle, then a sharp corner would exist directly in the path that incoming recyclable materials would encounter on their way into the interior portion of lower bin 100. Thus, the combination of base front upwardly sloping surface 34 and opening 30 to form recyclable receiving chute 106 substantially improves the ease of recycling materials and use of bins 100', 100.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties.

What is claimed is:

1. A bin, comprising:

a base, a left sidewall, a right sidewall, a front wall a rear wall, all fixedly connected to each other;

a handle configured to be freely rotatable wherein the handle can be rotated to a resting position upon a top portion of the rear wall;

a rear base groove, located at a rearward portion of the base; and a rear wall lower lip, located at a lowermost portion of the rear wall, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base, wherein each of the right sidewall and the left sidewall includes at least one respective inverted "V"-shaped liner retaining device configured to retain at least one liner, and wherein the rear base groove and the rear wall lower lip of a first upper bin are configured to jointly operate to fit about the handle of a substantially similar stacked second lower bin, when the handle of the second lower bin is in the resting position, to substantially prevent the first upper bin from sliding or moving forward with respect to the second lower bin.

2. The bin according to claim 1, wherein the first, second, third and fourth predetermined angle measures between about 92.5° and about 94.5°.

3. The bin according to claim 1, wherein the first, second, third and fourth predetermined angle measures between about 93.3° and about 93.7°.

4. The bin according to claim 1, wherein the first, second, third and fourth predetermined angle measures about 93.5°.

5. The bin according to claim 1, wherein each of the left sidewall and right sidewall includes a respective front sloped portion, wherein a height of the front wall is substantially equal to a lowest height of each of the left and right sidewall front sloped portions.

6. The bin according to claim 5, wherein the left sidewall front sloped portion is formed at a fifth predetermined angle with respect to an upper surface of the left sidewall, and the right sidewall front sloped portion is formed at a sixth predetermined angle with respect to an upper surface of the right sidewall.

7. The bin according to claim 6, wherein the fifth and sixth predetermined angle measures between about 45° and 55°.

8. The bin according to claim 6, wherein the fifth and sixth predetermined angle measures between about 47.5° and 52.5°.

9. The bin according to claim 6, wherein the fifth and sixth predetermined angle measures about 50°.

10. The bin according to claim 1, wherein when the handle is placed in the resting position upon the top portion of the rear wall of the bin, the handle is configured to retain a liner in the bin.

11. The bin according to claim 1, wherein when the handle is placed in the resting position upon the top portion of the rear wall of the bin, the handle is configured to provide a smooth, substantially planar surface formed by respective upper surfaces of the left sidewall and the right sidewall, and an upper surface of the handle.

12. A bin, comprising:

a base, a left sidewall, a right sidewall, a front wall;

a rear wall, all fixedly connected to each other, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base, and wherein the rear wall includes a top open portion, such that a height of the rear wall is less than a height of the each of the left sidewall and right sidewall, and each of the left sidewall and the right sidewall includes an upper surface that is substantially coplanar with each other; and a handle, wherein the handle includes a liner retention portion, a first and second arm portion, and a first and second rotatable mounting portion, wherein the handle is configured to be placed in any one of a liner retention position, a resting position, and a bin carrying position, and rotatable through the positions, and wherein the liner retention portion is sized to fit within the top open portion of the rear wall when the handle is in the liner retention position, such that a substantially planar surface is formed by the upper surface of the left sidewall, the upper surface of the right sidewall, and an upper surface of the liner retention portion of the handle.

13. The bin according to claim 12, wherein the first, second, third, and fourth predetermined angle measures between about 92.5° and about 94.5°.

14. The bin according to claim 12, wherein the first, second, third, and fourth predetermined angle measures between about 93.3° and about 93.7°.

15. The bin according to claim 12, wherein the first, second, third, and fourth predetermined angle measures about 93.5°.

16. The bin according to claim 12, wherein each of the left sidewall and right sidewall includes a respective front sloped portion, wherein a height of the front wall is substantially equal to a lowest height of each of the left and right sidewall front sloped portions.

17. The bin according to claim 16, wherein the left sidewall front sloped portion is formed at a fifth predetermined angle with respect to an upper surface of the left sidewall, and the right sidewall front sloped portion is formed at a sixth predetermined angle with respect to an upper surface of the right sidewall.

18. The bin according to claim 17, wherein the fifth and sixth predetermined angle measures between about 45° and 55°.

19. The bin according to claim 17, wherein the fifth and sixth predetermined angle measures between about 47.5° and 52.5°.

20. The bin according to claim 17, wherein the fifth and sixth predetermined angle measures about 50°.

21. A bin, comprising:

a base, a left sidewall, a right sidewall, a front wall;

a rear wall, all fixedly connected to each other, wherein the left sidewall extends from the base at a first predetermined angle to the base, the right sidewall extends from the base at a second predetermined angle to the base, the front wall extends from the base at a third predetermined angle to the base, and the rear wall extends from the base at a fourth predetermined angle to the base;

a handle, wherein the handle is configured to be freely rotatable, and further wherein the handle can be rotated to a resting position upon a top portion of the rear wall;

a rear base groove, located at a rearward portion of the base; and a rear wall lower lip, located at a lowermost portion of the rear wall, wherein the rear base groove and the rear wall lower lip of a first upper bin are configured to jointly operate to fit about the handle of a substantially similar stacked second lower bin, when the handle of the second lower bin is in the resting position, to substantially prevent the first upper bin from sliding or moving forward with respect to the second lower bin.

22. The bin according to claim 21, wherein the first, second, third, and fourth predetermined angle measures between about 92.5° and about 94.5°.

23. The bin according to claim 21, wherein the first, second, third, and fourth predetermined angle measures between about 93.3° and about 93.7°.

24. The bin according to claim 21, wherein the first, second, third, and fourth predetermined angle measures about 93.5°.

25. The bin according to claim 21, wherein each of the left sidewall and right sidewall includes a respective front sloped portion, wherein a height of the front wall is substantially equal to a lowest height of each of the left and right sidewall front sloped portions.

26. The bin according to claim 25, wherein the left sidewall front sloped portion is formed at a fifth predetermined angle with respect to an upper surface of the left sidewall, and the right sidewall front sloped portion is formed at a sixth predetermined angle with respect to an upper surface of the right sidewall.

27. The bin according to claim 26, wherein the fifth and sixth predetermined angle measures between about 45° and 55°.

28. The bin according to claim 26, wherein the fifth and sixth predetermined angle measures between about 47.5° and 52.5°.

29. The bin according to claim 26, wherein the fifth and sixth predetermined angle measures about 50°.

* * * * *